US011007531B2

(12) United States Patent
Kelsey et al.

(10) Patent No.: US 11,007,531 B2
(45) Date of Patent: May 18, 2021

(54) ADJUSTABLE SUPER FINE CRUSHER

(71) Applicant: IMP TECHNOLOGIES PTY LTD, Wollongong (AU)

(72) Inventors: Christopher George Kelsey, Hope Forest (AU); Christopher Simon Kelsey, Hope Forest (AU)

(73) Assignee: IMP Technologies Pty Ltd

( * ) Notice: Subject to any disclaimer, the term of this patent is extended or adjusted under 35 U.S.C. 154(b) by 1011 days.

(21) Appl. No.: 14/899,467

(22) PCT Filed: Jul. 22, 2014

(86) PCT No.: PCT/AU2014/000746

§ 371 (c)(1),
(2) Date: Dec. 17, 2015

(87) PCT Pub. No.: WO2015/010157

PCT Pub. Date: Jan. 29, 2015

(65) Prior Publication Data

US 2016/0136648 A1 May 19, 2016

(30) Foreign Application Priority Data

| | | |
|---|---|---|
| Jul. 22, 2013 | (AU) | 2013902714 |
| Nov. 21, 2013 | (AU) | 2013904505 |
| May 16, 2014 | (AU) | 2014901812 |

(51) Int. Cl.

| | |
|---|---|
| ***B02C 2/04*** | (2006.01) |
| ***B02C 19/11*** | (2006.01) |
| ***B02C 2/00*** | (2006.01) |

(52) U.S. Cl.

CPC ..... *B02C 2/04* (2013.01); *B02C 2/005* (2013.01); *B02C 19/11* (2013.01); *B02C 2002/002* (2013.01)

(58) Field of Classification Search

CPC ..... B02C 2/04; B02C 2/005; B02C 19/11; B02C 2002/002

See application file for complete search history.

(56) References Cited

U.S. PATENT DOCUMENTS 3,056,561 A * 10/1962 Hukki ..... B02C 17/002 241/26
3,162,382 A * 12/1964 Danyluke ..... B02C 13/1835 241/53

(Continued)

FOREIGN PATENT DOCUMENTS

CN 1081090 C * 3/2002
CN 101855020 A 10/2010

(Continued)

OTHER PUBLICATIONS

English translate (DE19614295A1), retrieved date Apr. 26, 2020.*
English translate (CN1081090C), retrieved date Apr. 26, 2020.*

*Primary Examiner* — Adam J Eiseman
*Assistant Examiner* — Mohammed S. Alawadi
(74) *Attorney, Agent, or Firm* — Sand, Sebolt & Wernow Co., LPA

(57) ABSTRACT

A mill for the comminution of particulate material by impact means including a shell rotating at super critical velocity and a gyrating mandrel. Material introduced to the mill forms a bed on the inner surface of the shell and is then crushed by the impact of the gyrating mandrel. The axis of rotation of the shell is in angularly displaced from the axis of gyration of the mandrel to transport material through the mill.

15 Claims, 22 Drawing Sheets

(56) References Cited

U.S. PATENT DOCUMENTS 3,312,404 A 4/1967 Allen
4,061,279 A * 12/1977 Sautter ..... B02C 13/1835 241/86.1
RE30,919 E * 5/1982 Sautter ..... B02C 13/1835 241/275
4,434,944 A * 3/1984 Bodine ..... B02C 2/042 241/258
4,679,741 A * 7/1987 Hansen ..... B02C 2/045 241/101.2
4,681,269 A * 7/1987 Arakawa ..... B02C 2/047 241/101.2
4,735,366 A * 4/1988 Hoffmann ..... B02C 17/166 241/36
4,750,681 A * 6/1988 Sawant ..... B02C 2/04 241/208
4,779,808 A * 10/1988 Graf ..... B02C 2/04 241/206
4,848,683 A * 7/1989 Kawatsu ..... B02C 2/005 241/294
4,874,136 A * 10/1989 Webster ..... B02C 2/10 241/251
4,964,580 A * 10/1990 Akesaka ..... B02C 2/00 241/252
5,080,294 A * 1/1992 Dean ..... B02C 2/005 241/207
5,516,053 A * 5/1996 Hannu ..... B02C 2/005 241/207
5,637,434 A * 6/1997 Ikushima ..... B02C 2/10 241/24.28
5,810,269 A * 9/1998 Shannon ..... B02C 2/06 241/207
5,845,855 A * 12/1998 Yamada ..... B02C 13/10 241/57
6,007,009 A * 12/1999 Sheridan ..... B02C 2/04 241/207
6,036,129 A * 3/2000 Ambrose ..... B02C 2/04 241/207
6,179,233 B1 * 1/2001 Cordonnier ..... B02C 23/18 241/61
6,213,418 B1 * 4/2001 Gabriel ..... B02C 2/04 241/207
6,375,101 B1 * 4/2002 Kelsey ..... B02C 17/002 241/172
6,450,428 B1 * 9/2002 Kelsey ..... B02C 17/002 241/15
6,565,023 B2 5/2003 Schmitt
10,159,983 B2 * 12/2018 Loke ..... B02C 2/005
2001/0028006 A1 10/2001 Schmitt
2003/0131707 A1 * 7/2003 Yotsumoto ..... B28D 1/181 83/862
2004/0035967 A1 * 2/2004 Johnson ..... B02C 2/04 241/207
2006/0086852 A1 * 4/2006 Juhlin ..... B02C 2/005 241/207
2010/0282881 A1 * 11/2010 Pallmann ..... B02C 13/14 241/101.2
2012/0006919 A1 * 1/2012 Kelsey ..... B02C 17/04 241/30
2014/0103150 A1 * 4/2014 Belotserkovskiy ..... B02C 25/00 241/27
2015/0129696 A1 * 5/2015 Andrienko ..... B02C 2/042 241/215
2016/0114330 A1 * 4/2016 Roper ..... B02C 2/04 241/32

FOREIGN PATENT DOCUMENTS

DE 1225027 9/1966
DE 19614295 A1 * 10/1996 ..... B02C 17/168
EP 0402545 12/1990
JP 59-500754 5/1984
JP 61000458 1/1986
JP 63-133342 8/1988
WO 83/03779 11/1983
WO 93/15838 8/1993
WO 2008/148928 12/2008
WO 2009/029982 3/2009

* cited by examiner

ADJUSTABLE SUPER FINE CRUSHER

FIELD OF THE INVENTION

The present specification relates generally to a crushing mill and more specifically relates to a crushing mill for the comminution of particulate material by a mandrel to produce super fine material.

The invention has been developed for the comminution of minerals and the following description will detail such a use. However it is to be understood that the invention is also suitable for the comminution of a wide variety of materials such as ceramics and pharmaceuticals.

BACKGROUND

Grinding of particulate material is commonly performed in rotary mills which rotate at sub-critical speed causing a tumbling action of material as it travels up the inner wall of the mill then falls away to impact or grind against other materials. This results in the reduction of particles by a combination of abrasion and impact. Such mills consume a vast amount of energy.

Mills operating at super-critical speed are also known, such as those disclosed in WO99/11377 and WO2009/029982. These mills include shear inducing members for the reduction of particles and offer improved energy efficiencies over traditional rotary mills. However, these mills still consume significant amounts of energy.

The object of this invention is to provide a mill that uses significantly less energy than contemporary mills, or at least provides the public with a useful alternative.

SUMMARY OF THE INVENTION

In a first aspect the invention provides a mill for crushing particulate material, comprising a rotatory shell and a mandrel wherein the shell rotates such that the material forms a layer retained against an inner surface of the shell; and the mandrel impacts the layer of material thereby crushing the material.

Preferably the mandrel gyrates to impact the layer of material.

In preference the shell rotates about a shell axis and the mandrel gyrates about a mandrel axis which is angularly displaced from the shell axis.

Preferably the inner surface of the shell comprises a first conical frustum with a first lateral surface disposed at a first angle to a first axis and the mandrel comprises a second conical frustum with a second lateral surface disposed at a second angle to a second axis.

In preference the second angle of the second frustum is twice the first angle of the first frustum or the second frustum is less than twice the first angle of the first frustum.

Preferably the mandrel further comprises a cylinder and the angular displacement of the mandrel axis from the shell axis is equivalent to the first angle of the first conical frustum.

Preferably the shell is movable along the shell axis.

In a further aspect of the invention the inner surface of the shell comprises a first and second conical frusta and the mandrel comprises a cylinder.

Preferably the mandrel comprises a series of rows of teeth wherein the teeth in adjacent rows are offset with respect to each other.

In preference each row of teeth comprises a disc in which the teeth are detachably retained.

Preferably the mandrel includes a smooth outer surface and may include a stepped outer surface.

In a further aspect of the invention the mandrel oscillates to impact the layer of material.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DRAWING LABELS

Figure 1:
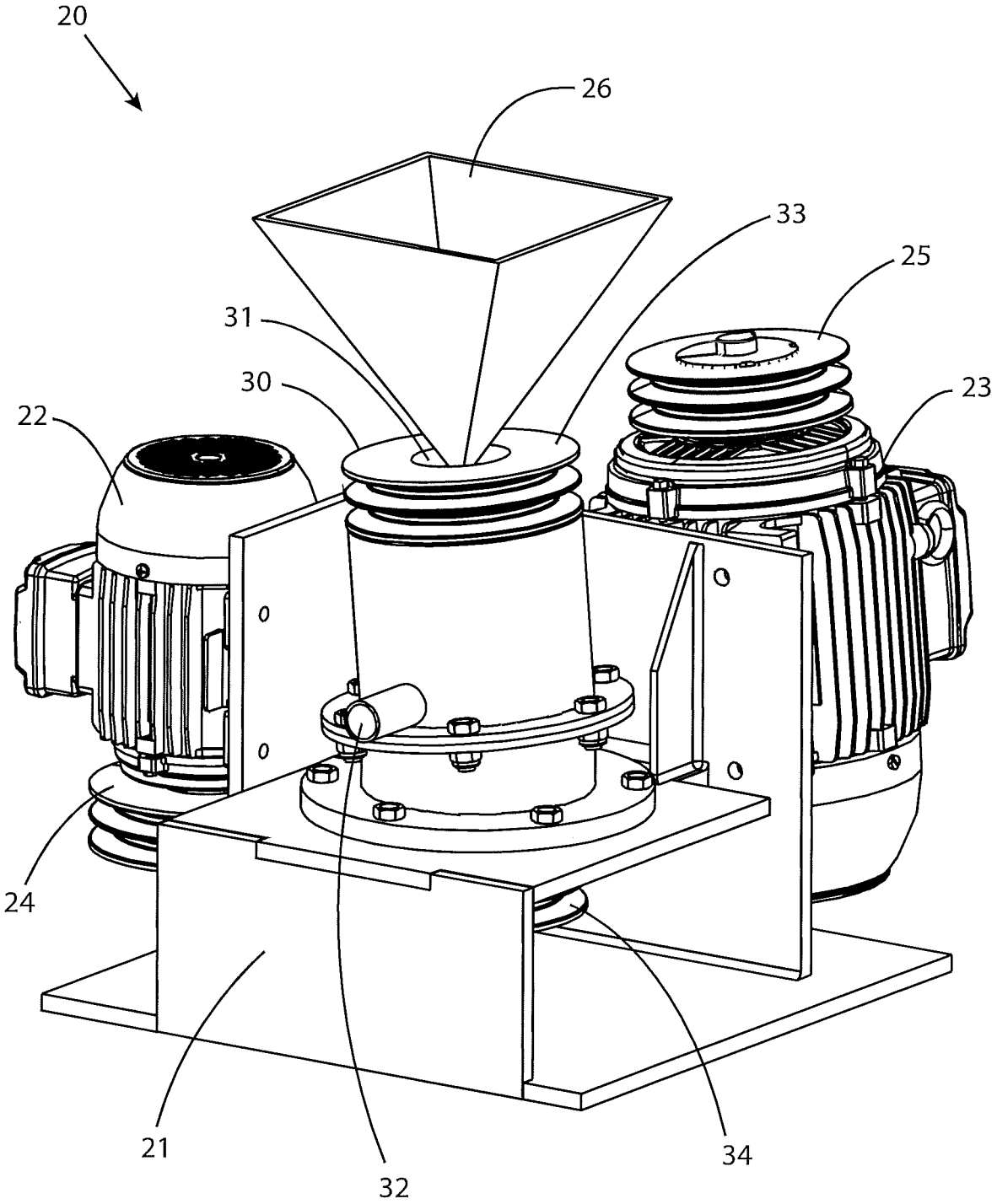
FIG. 1 shows a perspective view of a mill system incorporating a mill according to a first embodiment of the present invention.

The drawings include items labeled as follows:

20 Milling system
21 Support frame
22 Shaft motor
23 Shell motor
24 Shaft motor pulley
25 Shell motor pulley
26 Inlet chute
30 Mill (first embodiment)
31 Feed inlet
32 Discharge chute
33 Shell pulley
34 Shaft pulley
35 Angled base
36 Shell housing
37 Impeller
40 Shaft assembly
41 Drive shaft
42 Shaft rotation axis
43 Displacement angle
44 Gyratory shaft
45 Mounting shaft
46 Shaft joining plane
47 Mounting shaft extension
50 Rotatory shell
51,52 Shell bearings
53 Infeed chamber
54 Upper chamber
55 Lower chamber
56 Chamber central plane
57 Shell rotation axis
58 Chamber maximum
59 Chamber minimum
60 Shell rotation
61, 62 Lower shaft bearings
63, 64 Upper shaft bearings
65 Mandrel
66 End plate
70, 70' Impact disc
71 Disc body
72 Disc mounting aperture
73 Impact tooth
80 Impact disc (second embodiment)
81 Disc body
82 Disc mounting aperture
83 Impact tooth
84, 85 Tooth cylinders
86 Tooth fillet
90 Shaft assembly (third embodiment)
91 Mandrel
100 Shaft assembly (fourth embodiment)
101 Drive shaft flange
102 Gyratory shaft flange
110 Shaft assembly (fifth embodiment)
111 First mandrel cylinder
112 Second mandrel cylinder
113 Third mandrel cylinder
500 Milling system (sixth embodiment)
510 Stand
511 Shaft motor
512 Inlet funnel
513 Outlet chute
520 Adjustable impact mill
521 Base
522 Body
523 Top
524 Pillars
530 Shell housing
531 Shell pulley
532 Shell bearings
540 Shaft assembly
541 Mandrel
542 Shaft
543 Offset shaft segment
544 Shaft lower bearing
545 Shaft upper bearing
546 Shaft shell bearings
547 Shaft pulley
548 Upper gap
549 Lower gap
550 Mill (seventh embodiment)
560 Hydraulic cylinder
561 Hydraulic piston

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration. Any usage of terms that suggest an absolute orientation (e.g. "top", "bottom", "front", "back", etc.) are for illustrative convenience and refer to the orientation shown in a particular figure. However, such terms are not to be construed in a limiting sense as it is contemplated that various components may in practice be utilized in orientations that are the same as, or different than those, described or shown. The use of various fasteners, seals, etcetera as is well known in the art is not discussed and such items are not shown in some figures for greater clarity.

The present invention provides a marked contrast to prior art mills in terms of the principle of operation, how it is achieved and the resultant efficiencies and other benefits obtained. Most prior art mills rely upon shearing for the comminution of material and achieve this with various rotating drums and shearing members and in doing so consume vast amounts of energy. Some recent developments as disclosed in WO99/11377 and WO2009/029982 have improved efficiencies, but still leave scope for further improvement. In contrast the present invention utilises low velocity impact of a gyrating member for comminution of material.

The invention provides a mill for crushing of particulate material, comprising a rotatory shell having an inner surface, means for rotating the shell at sufficiently high speed such that the material forms a layer retained against the inner surface and a mandrel to impact the layer and crush the material. The invention encompasses various embodiments for the mill as a whole, the shell and the mandrel. For brevity only a subset of the permutations of these components are discussed in detail, however the scope of the invention encompasses all permutations.

Figure 2:
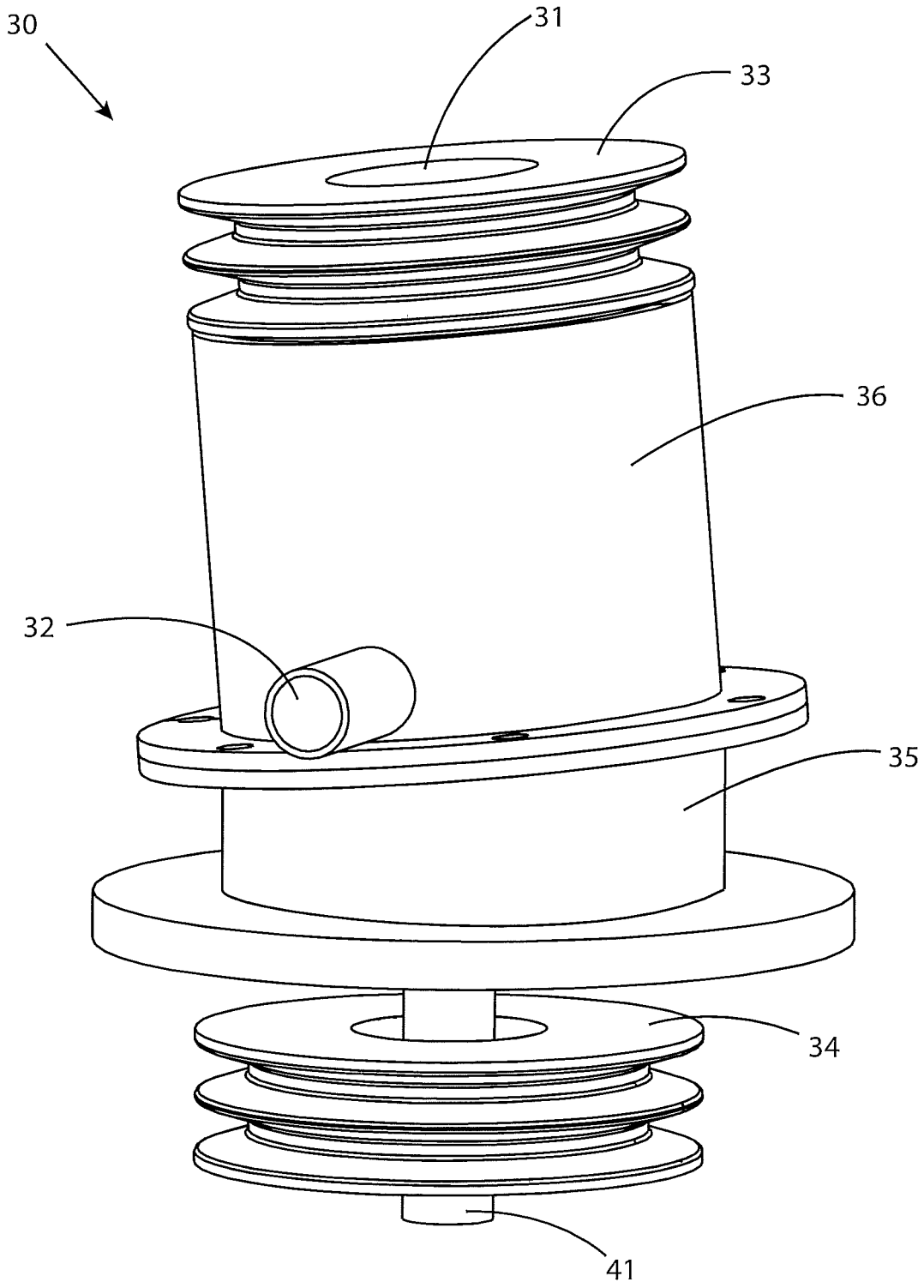
FIG. 2 shows the mill of FIG. 1 in isolation.

FIG. 1 shows a milling system 20 incorporating a gyratory impact mill 30 according to a first embodiment of the present invention. The mill 30 is mounted to a support frame 21 to which shaft motor 22 and shell motor 23 are also secured. The shaft motor 22 provides motive force to the drive shaft 41 (described below) of the mill via shaft motor pulley 24, belts (not shown) and shaft pulley 34 (which is shown partially obscured). Similarly the shell motor 23 drives the shell 50 (described below) of the mill via shell motor pulley 25, belts (not shown) and shell pulley 33. The two motors are mounted at an angle to each other as the drive shaft 41 and the shell 50 of the mill operate at an angle to each other. Raw material is fed into the feed inlet 31 of the mill via inlet chute 26 and discharged from the mill via discharge chute 32. The outwardly visible components of the mill 30 can be further appreciated with the aid of FIG. 2 which shows the mill 30 in isolation from the milling system 20.

Figure 3:
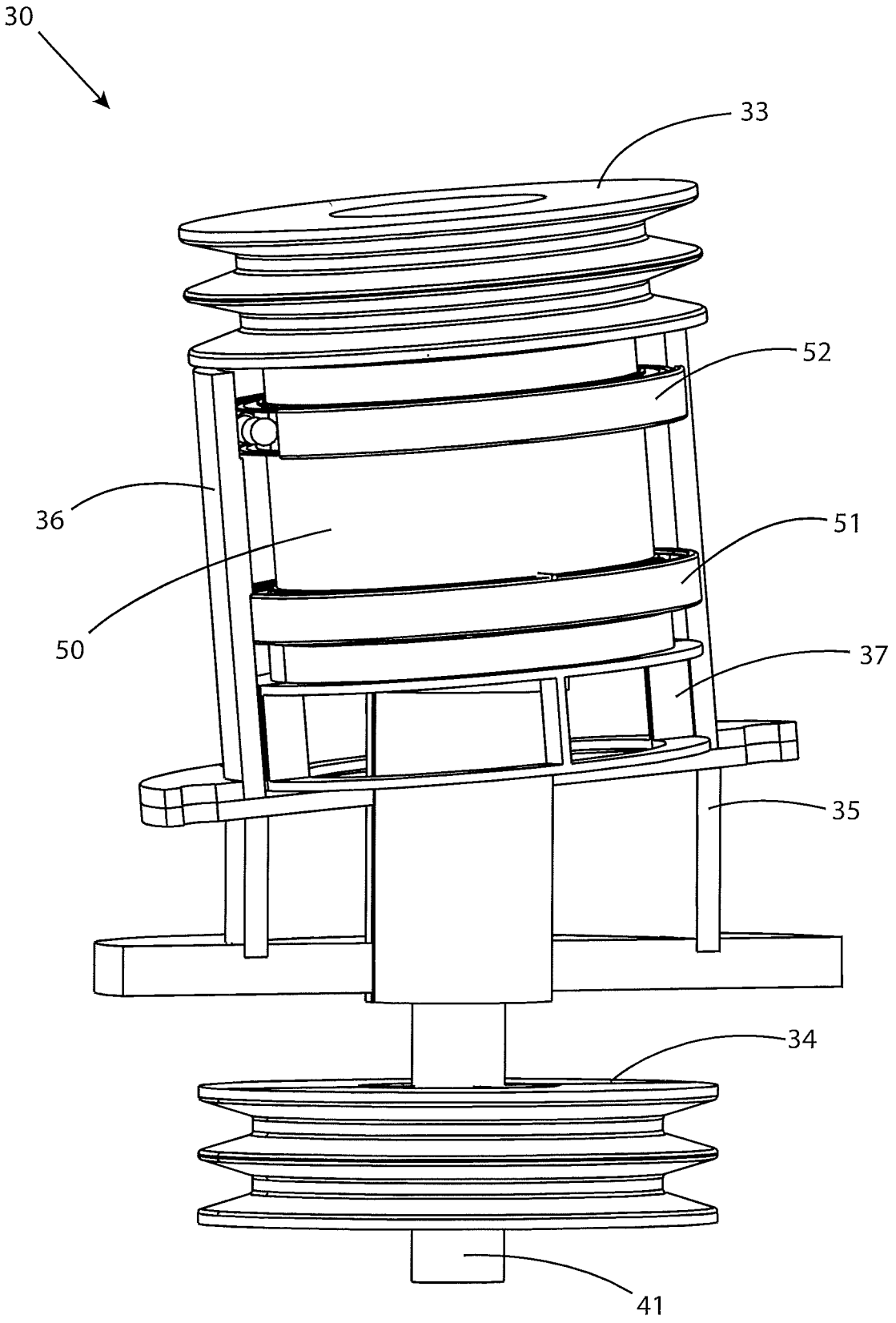
FIG. 3 shows the mill with its outer cover removed.
Figure 4:
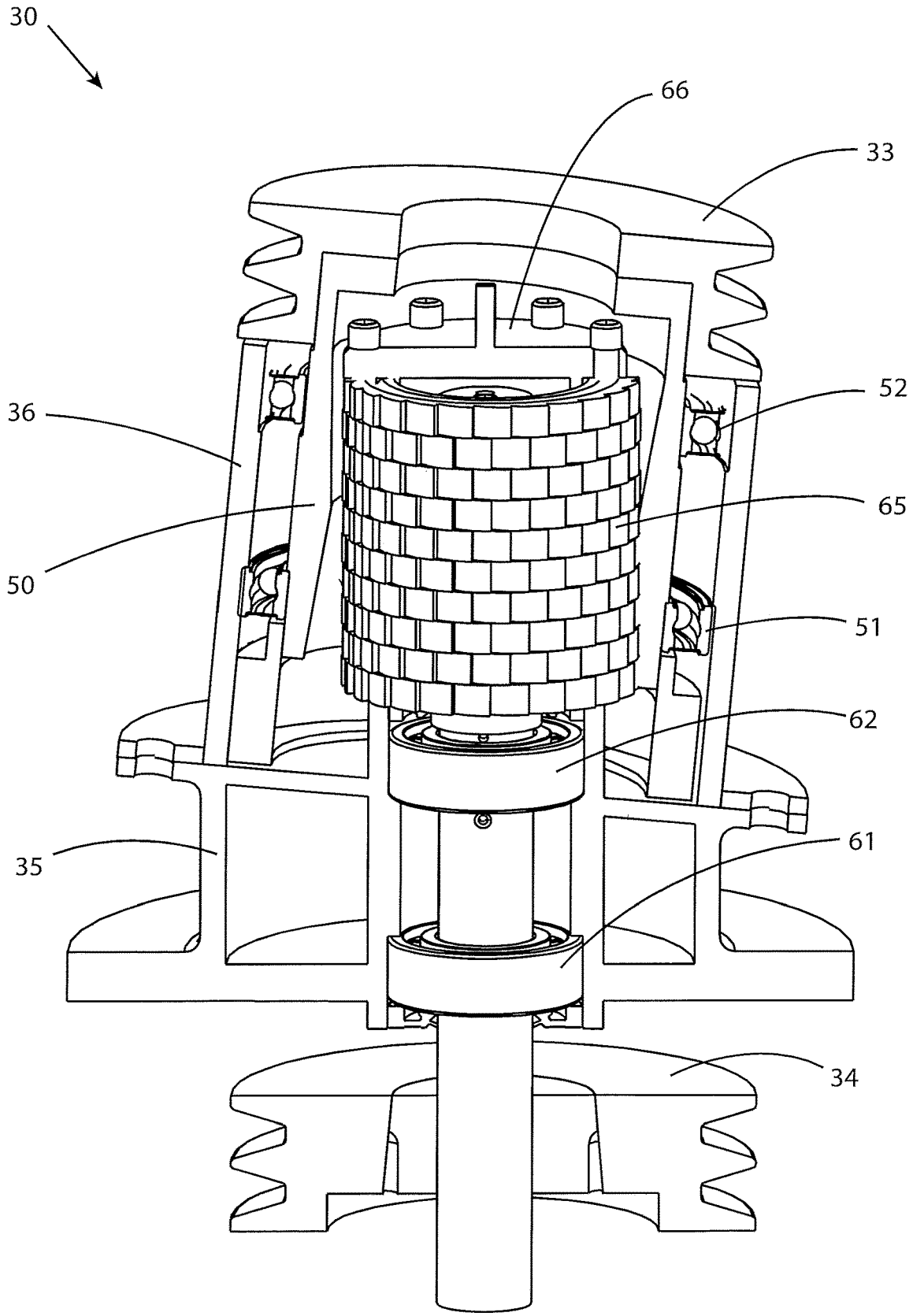
FIG. 4 shows a partial cutaway view of the mill revealing a mandrel.
Figure 5:
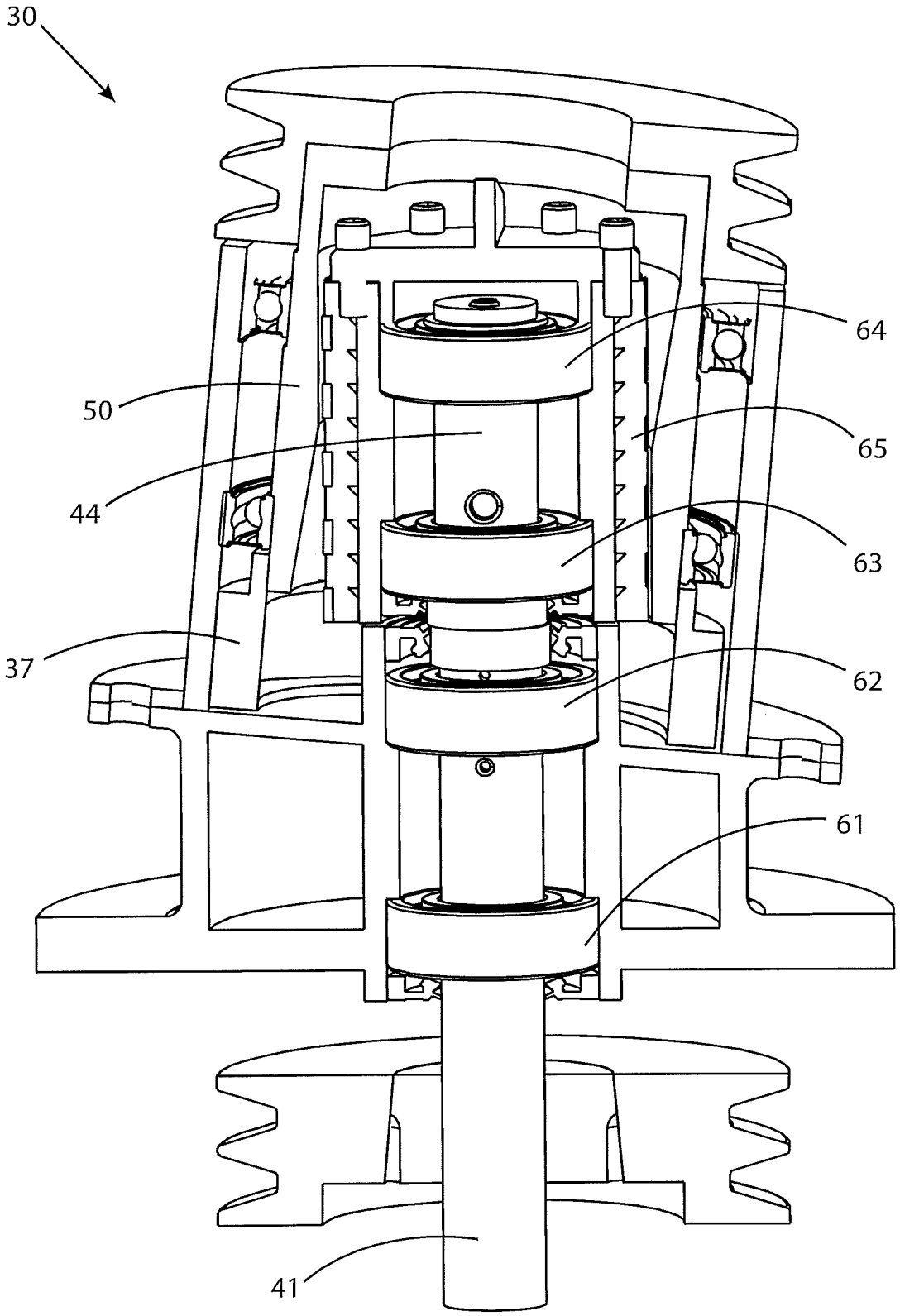
FIG. 5 is a further cutaway view with the mandrel cutaway.

The internal components of the mill 30 can be appreciated with FIGS. 3 to 5 which show progressively cutaway views. The principal components are the shell 50 which holds the material to be comminuted, and the mandrel 65 which gyrates within the shell to achieve the comminution by impact/crushing.

The mill 30 comprises an angled base 35 which supports drive shaft 41 via lower shaft bearings 61 and 62. The drive shaft is driven by pulley 34 and rotates the mandrel 65 which sits within shell 50. With the aid of shell bearings 51 and 52, the rotatory shell 50 is free to rotate within the outer housing 36 which in turn is secured to the angled base 35. The angled base provides an angular displacement between the axis of rotation of the shell 50 and the mandrel 65.

At the top of shell 50 is shell drive pulley 33 through which material enters the mill via feed inlet 31. To the bottom of the shell is attached an impeller 37 which evacuates the crushed material via discharge chute 32.

Within the mandrel 65 can be seen gyratory shaft 44 upon which the mandrel is mounted via upper shaft bearings 63 and 64. The mandrel is thus able to rotate independently of the gyratory shaft 44 and the drive shaft 41. The gyratory shaft 44 is attached to, but axially displaced from the drive shaft 41 in order to impart a gyratory motion to the mandrel. An axial displacement of 1 mm has been found appropriate over a wide range of use. Atop of the mandrel sits end plate 66 to protect against the ingress of material.

Figure 6:
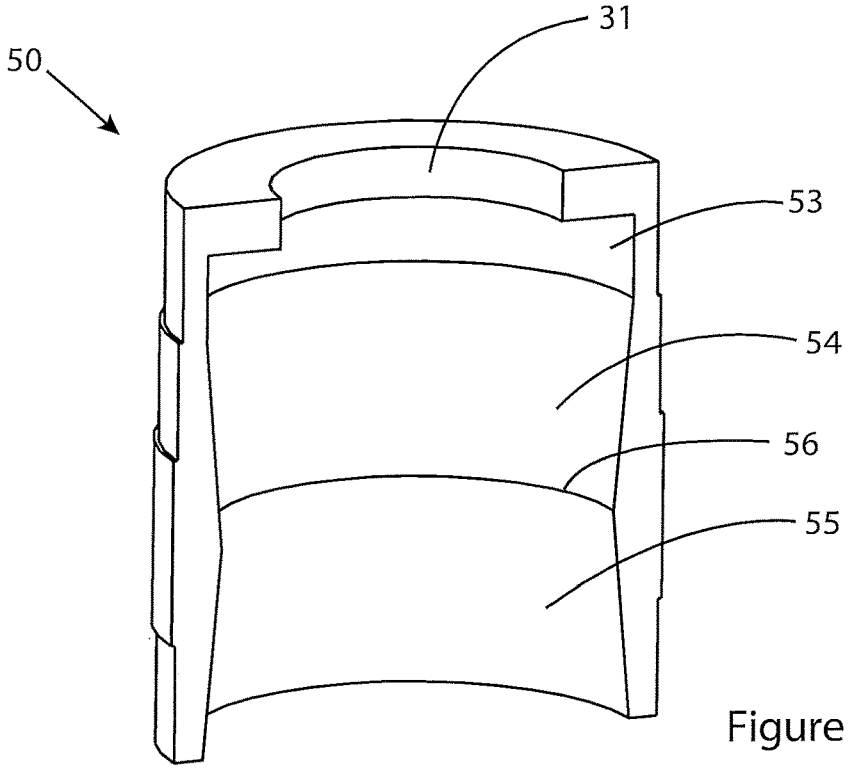
FIG. 6 shows a cutaway view of the shell in which material is crushed.
Figure 7:
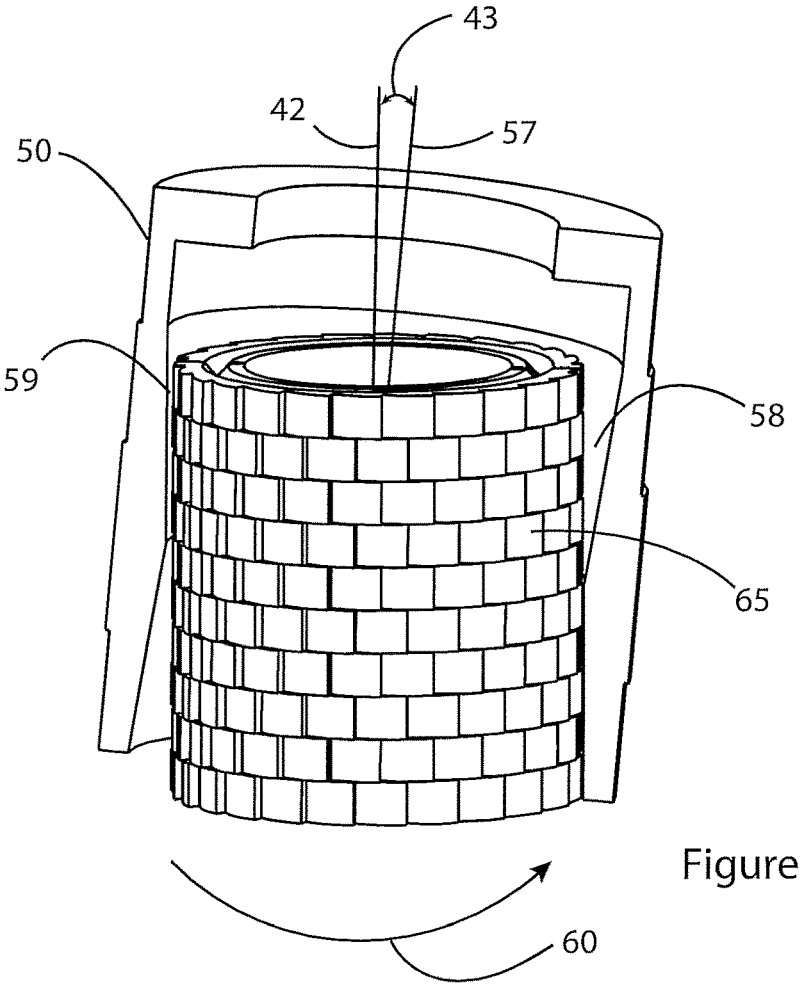
FIG. 7 shows the mandrel within the shell.

The rotatory shell 50 is shown in isolation in FIG. 6 and with mandrel 65 positioned in FIG. 7. Externally the shell is cylindrical in shape with a feed inlet 31 at the top for the entry of material and open at the bottom for discharging crushed material. The shell rotates about axis 57 which is angularly displaced from the axis 42 about which the mandrel rotates by an angle of approximately 5 degrees (shown as 43). The angular displacement encourages movement of material down through the shell. Internally the shell comprises infeed chamber 53 which provides passage for material into the shell and clearance for the end plate 66 (as seen in FIG. 5), upper chamber 54 and lower chamber 55 in the form of conical frusta joined at their smaller planes along the chamber central plane 56. The frustoconical sides have a corresponding angle to the axial displacement angle 43. This together with the cylindrical shape of the mandrel results in a chamber minimum 59 and chamber maximum 58. Material entering the shell will mostly fall into chamber maximum 58. The shell rotates at a super-critical velocity such that the material entering the shell will form a compressed solidified layer on the inner walls of the shell. The rotation of the shell in direction 60 will draw the material around to chamber minimum 59 where it will be crushed by the gyratory action of the mandrel. The chambers are sized such that the chamber minimum is approximately 1 mm. As the mandrel is free to rotate it will tend to rotate in unison with the shell resulting in zero or minimal velocity between the two components. As a result the material is not subject to a shearing action, but instead crushed by the gyratory action of the mandrel. The gyratory shaft 44 (seen in FIG. 10) is driven at approximately 1,500 rpm resulting in a low impact velocity of 0.15 m/s. The low impact velocity together with the lack of shearing action minimizes wear upon the mandrel and also results in reduced energy needed to crush the material.

Figure 8:
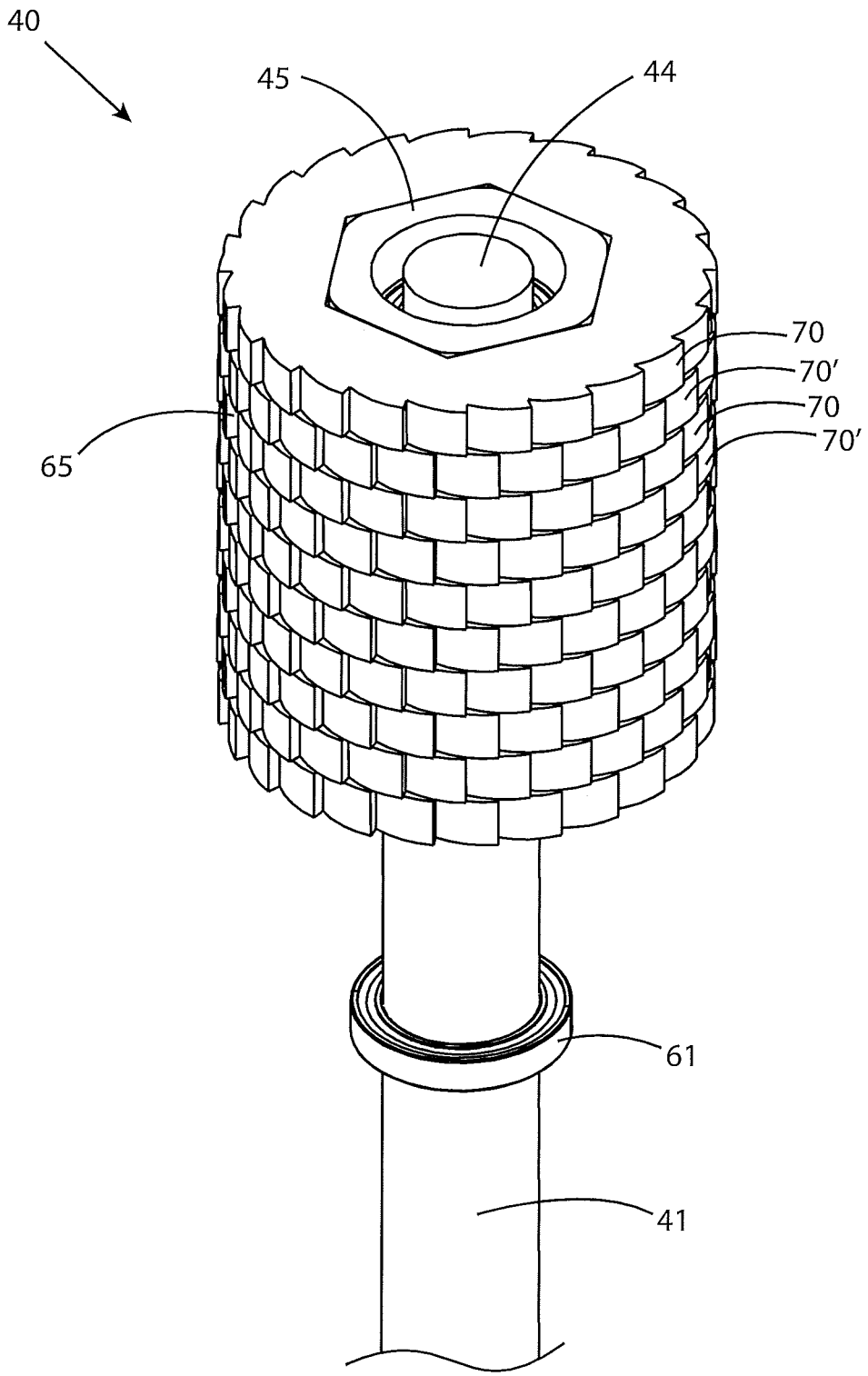
FIG. 8 shows a shaft assembly including a mandrel with fixed teeth.
Figure 9:
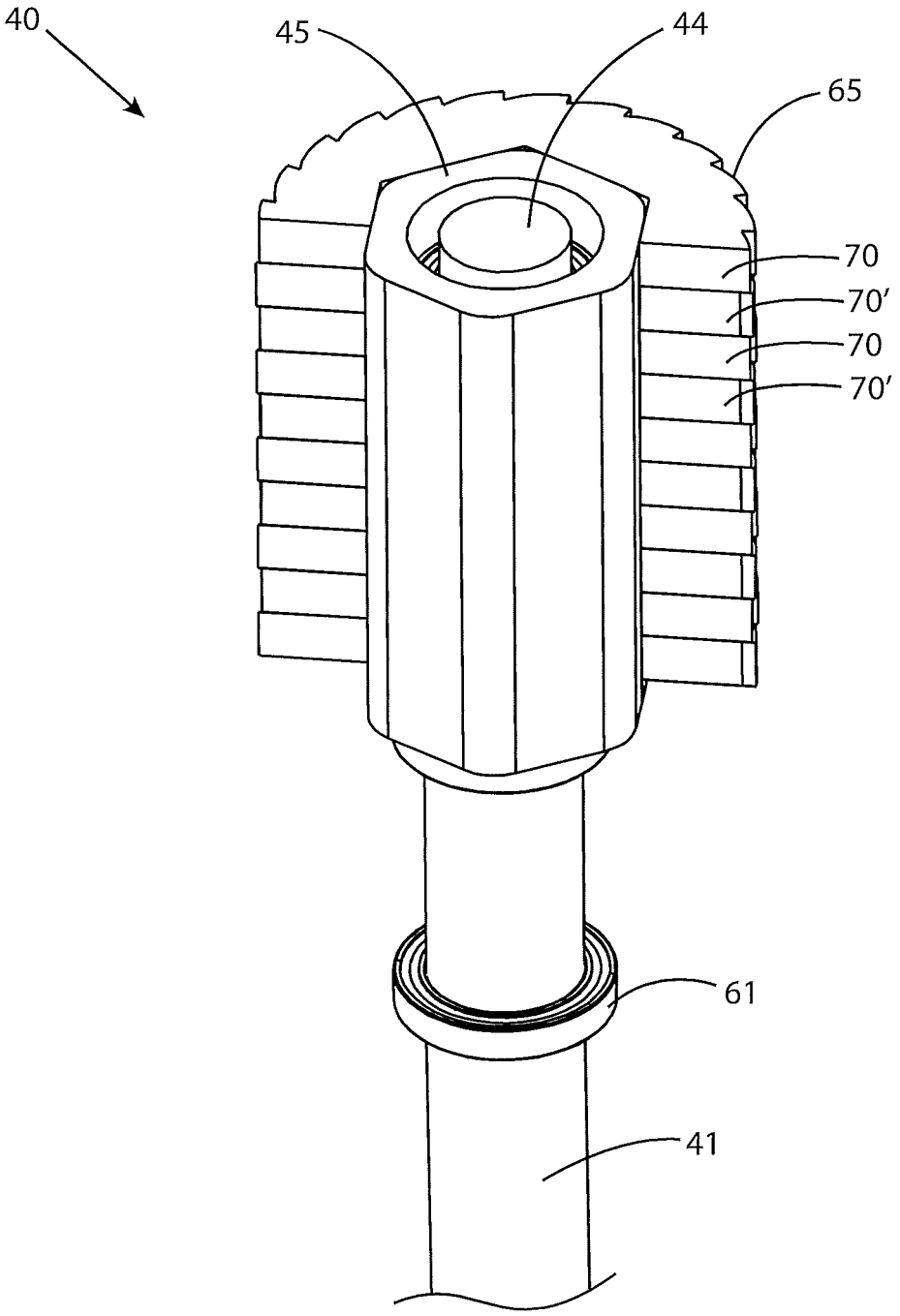
FIG. 9 shows a cutaway view of the mandrel of FIG. 8.
Figure 10:
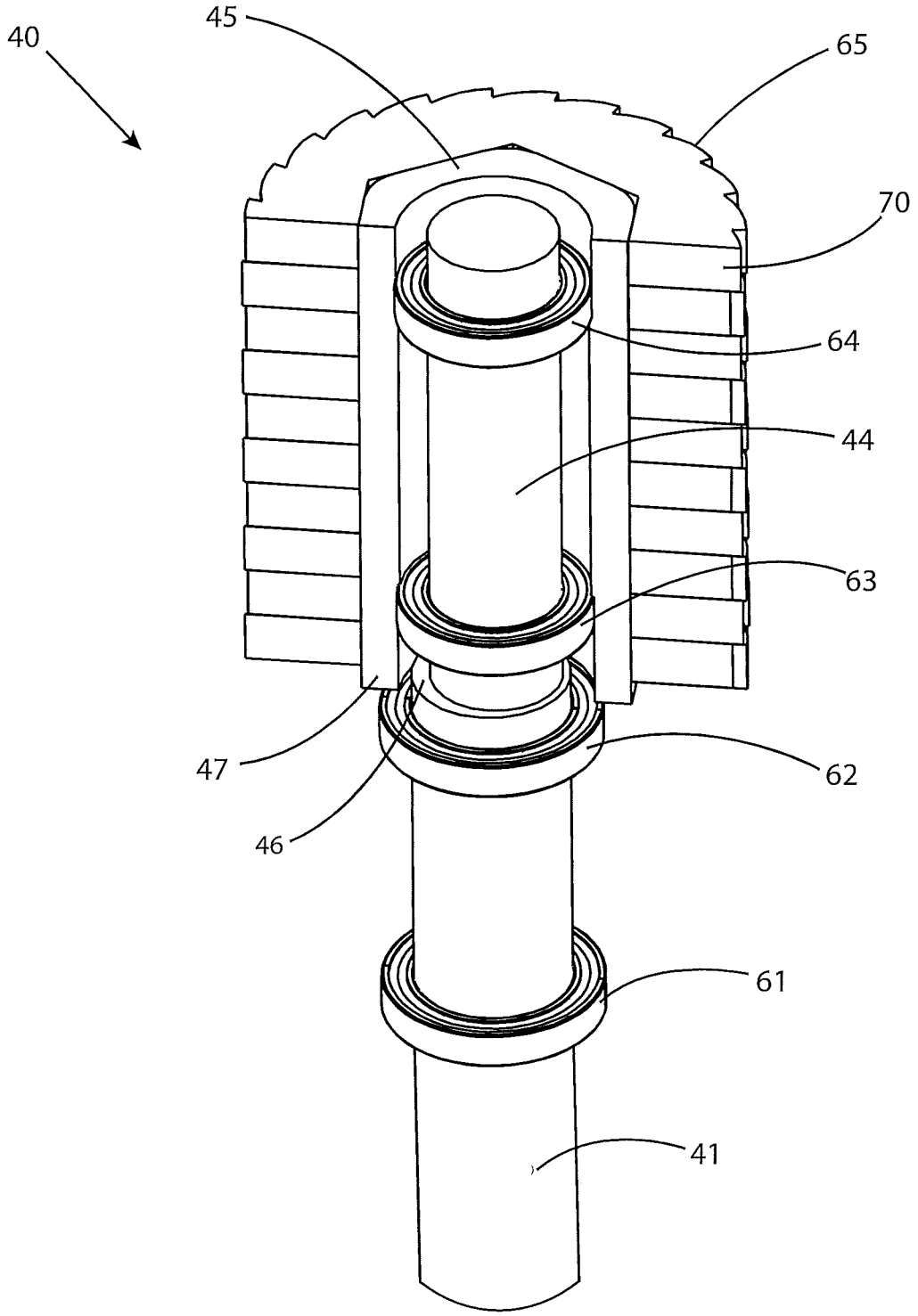
FIG. 10 is a further cutaway of the mandrel showing bearing mounting and gyratory shaft offset.
Figure 11:
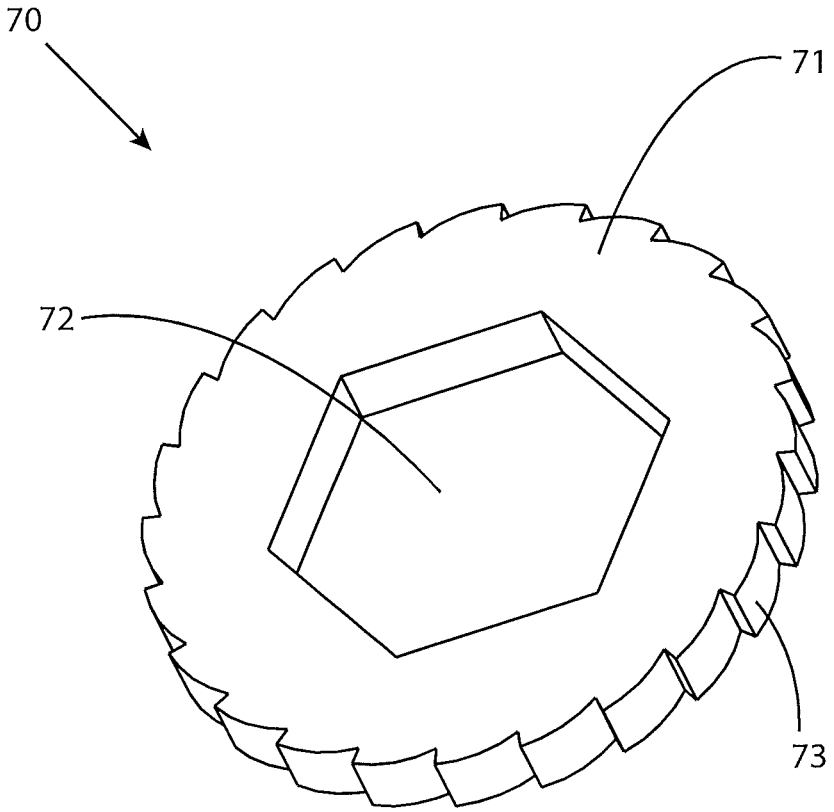
FIG. 11 shows an impact disc of the mandrel.

FIGS. 8 to 10 detail the shaft assembly 40 which brings together the drive shaft 41, gyratory shaft 44 and mandrel 65. Details of an impact disc 70 of the mandrel can be seen in FIG. 11. The mandrel is formed from a stack of impact discs 70 to form a cylindrical mandrel 65. The discs 70 comprise an annular disc body 71, hexagonal mounting aperture 72 and impact teeth 73. A variant of the disc 70' has a different angular offset of the impact teeth with respect to the mounting aperture. The two variants 70 and 70' are stacked alternatively as seen in FIG. 8 and FIG. 9 to produce an alternating pattern of teeth. The discs are mounted on the hexagonal mounting bar 45 which in turn is mounted to the gyratory shaft 44 via upper shaft bearings 63 and 64. As can be seen in FIG. 10 at the shaft joining plane 46 the gyratory shaft 44 is connected to the drive shaft 41, but axially displaced resulting in gyration of the mandrel as the drive shaft rotates.

The mounting bar 45 extends below the stack of impact discs to form an extension 47. In an alternative embodiment of the mill (not shown) the base 35 incorporates a correspondingly shaped but slightly larger receptacle for accepting the extension to prevent the mandrel from rotating whilst still permitting it to gyrate.

Figure 12:
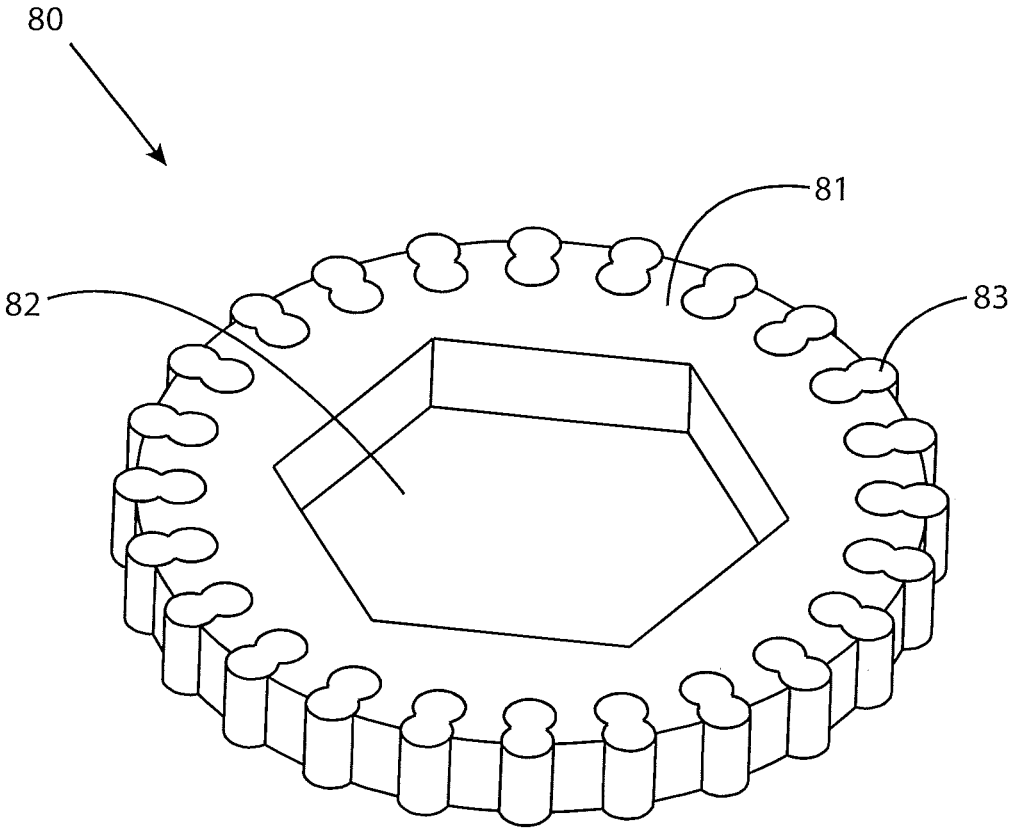
FIG. 12 shows an impact disc of a second embodiment including removable teeth.
Figure 13:
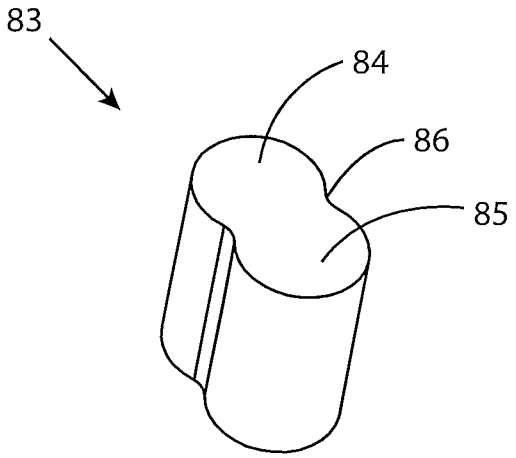
FIG. 13 shows a tooth of the impact disc of FIG. 12.

A second embodiment of the impact disc is shown as 80 in FIG. 12. The disc 80 is similar to the disc 70 in having an annular body 81 and hexagonal mounting aperture 82, but differs in having replaceable teeth 83. A tooth 83 is shown in greater detail in FIG. 13 and comprises two cylinders 84 and 85 joined by a fillet 86. The symmetrical nature of the tooth allows either cylinder 84 or 85 to be inserted into the body 81. A tooth can be reversed after it has worn at one end thus halving the frequency at which they need to be replaced. The disc shown has 24 teeth resulting in an angular displacement between the teeth of 15 degrees. The teeth are displaced from the axis of the hexagonal mounting aperture by a quarter of their own angular displacement, i.e. 3.75 degrees. As a result only one variant of the disc is needed to produce the alternating teeth arrangement (similar to that seen in FIG. 8) by simply flipping every alternate disc when putting together mandrel 65. Preferably the teeth are made of a hard material such as tungsten carbide.

Figure 14:
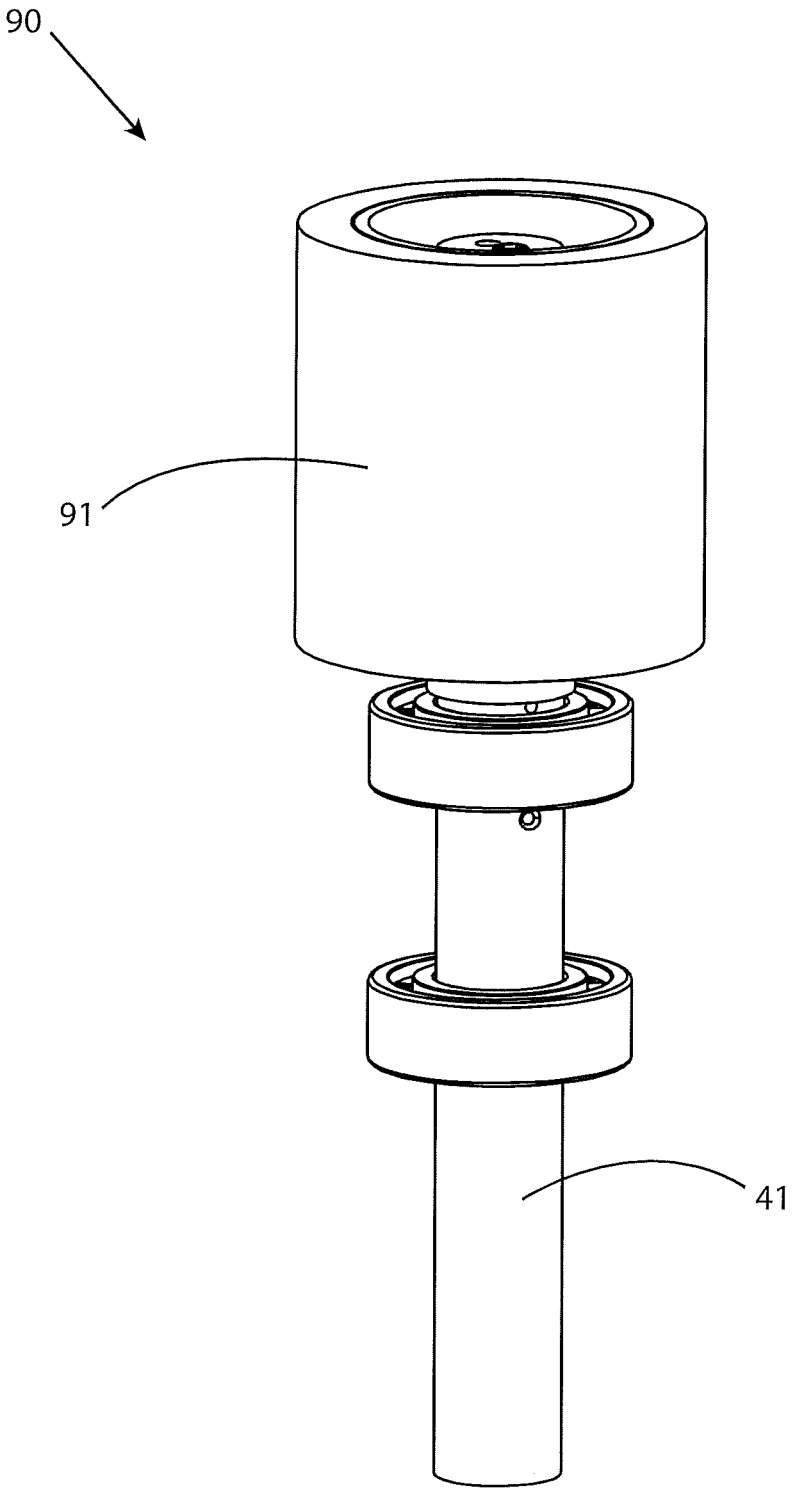
FIG. 14 shows a shaft assembly of a third embodiment incorporating a mandrel with a smooth outer surface.
Figure 15:
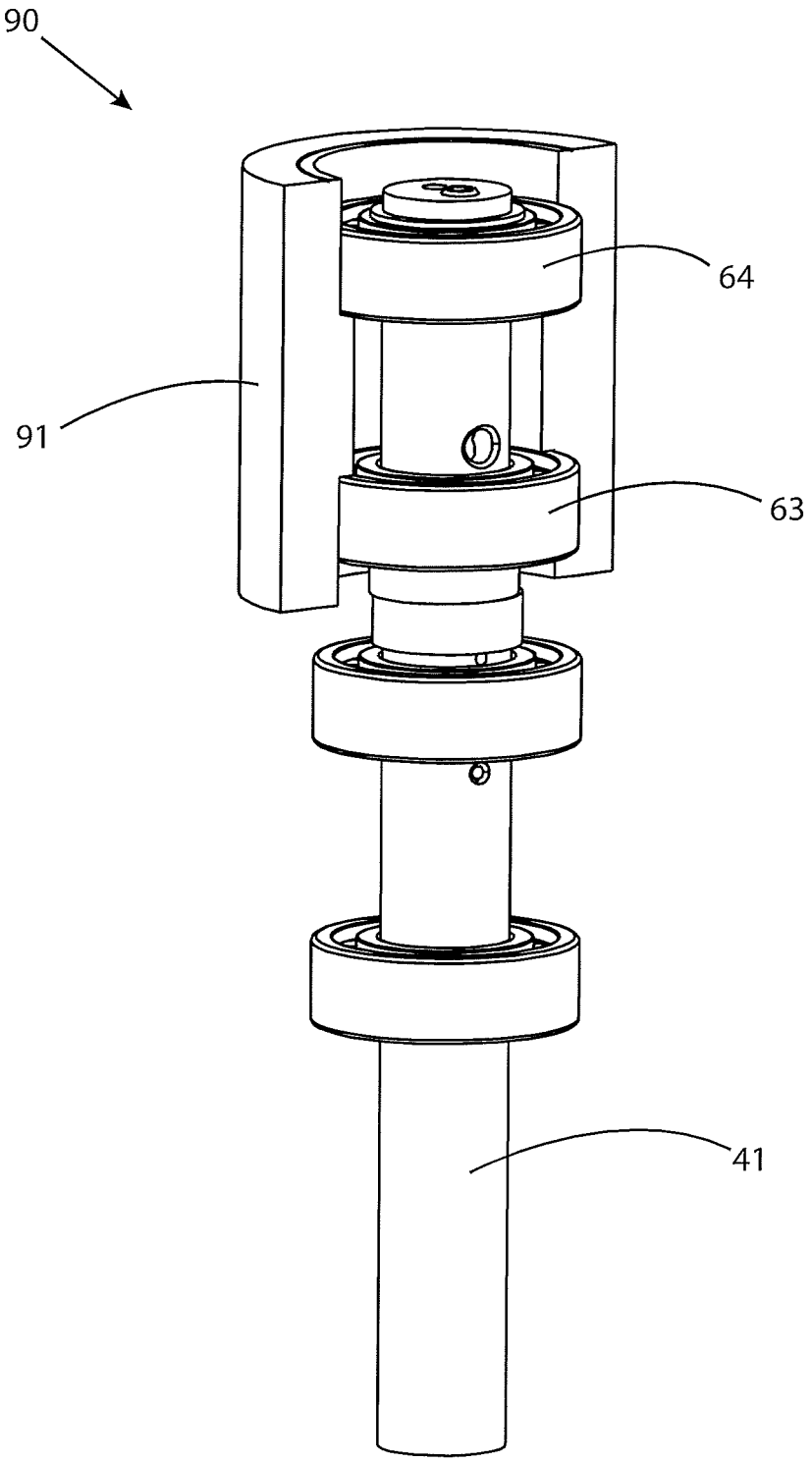
FIG. 15 is a cutaway view of the shaft assembly of FIG. 14.

A third embodiment of a shaft assembly is shown as 90 in FIGS. 14 and 15 including a smooth mandrel 91 which is suitable for producing finer material than possible with the toothed mandrel 65. The mandrel offers a much simpler construction and can be mounted directly to bearings on the gyratory shaft, abrogating the need for a mounting bar.

Figure 16:
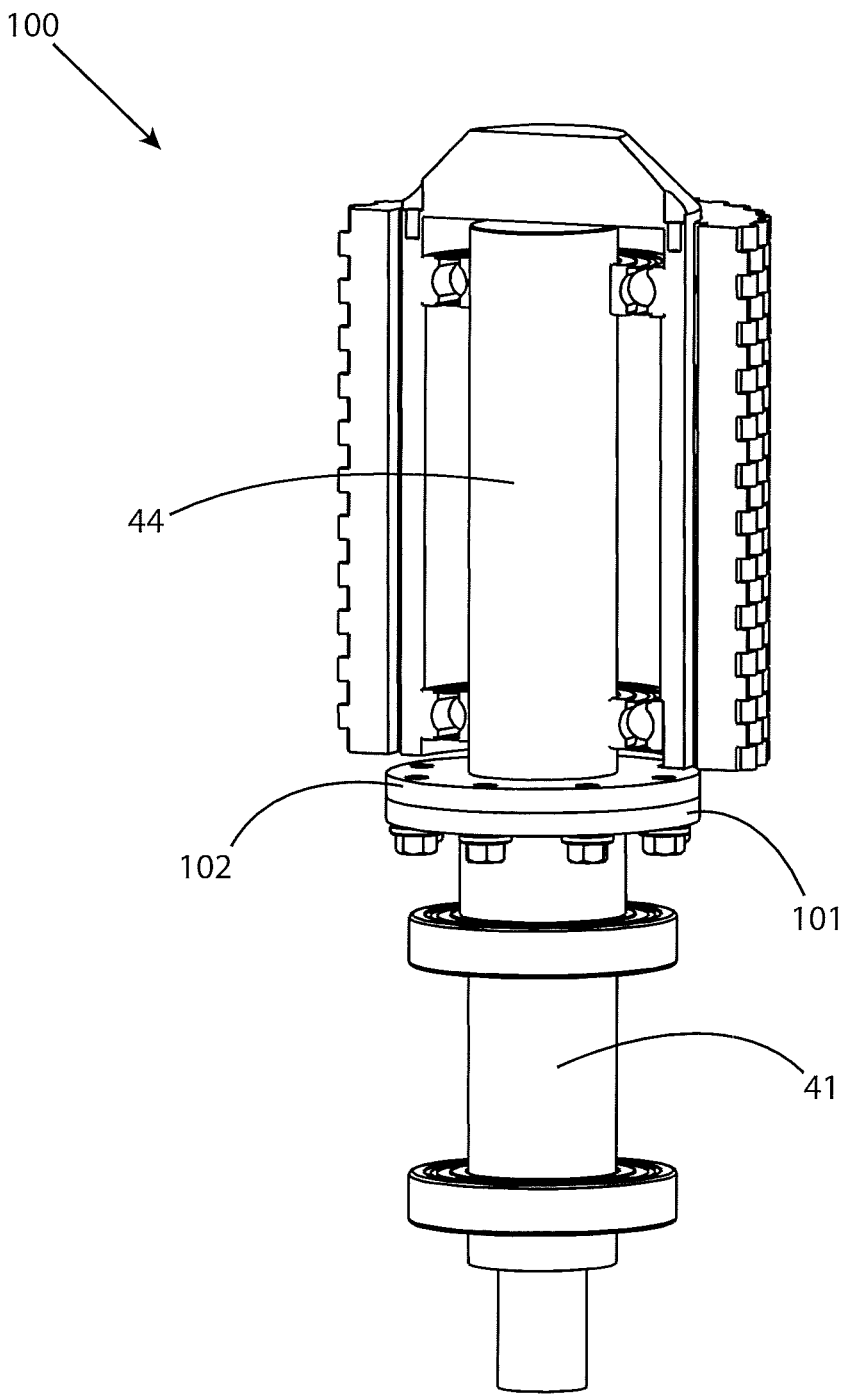
FIG. 16 is a cutaway view of a shaft assembly of a fourth embodiment with the drive shaft and gyratory shaft joined by flanges.

FIG. 16 illustrates a fourth embodiment of the shaft assembly 100 in which the gyratory shaft 44 is fitted with a flange 102 for attachment to a corresponding flange 101 on the end of the drive shaft 41. This arrangement allows components to be readily interchanged to for example use a mandrel of a different diameter or a gyratory shaft with a different offset as may be desired for different sized feed materials and end product size. Further embodiments incorporating any of the mandrels discussed together with the flange assembly are clearly possible.

Figure 17:
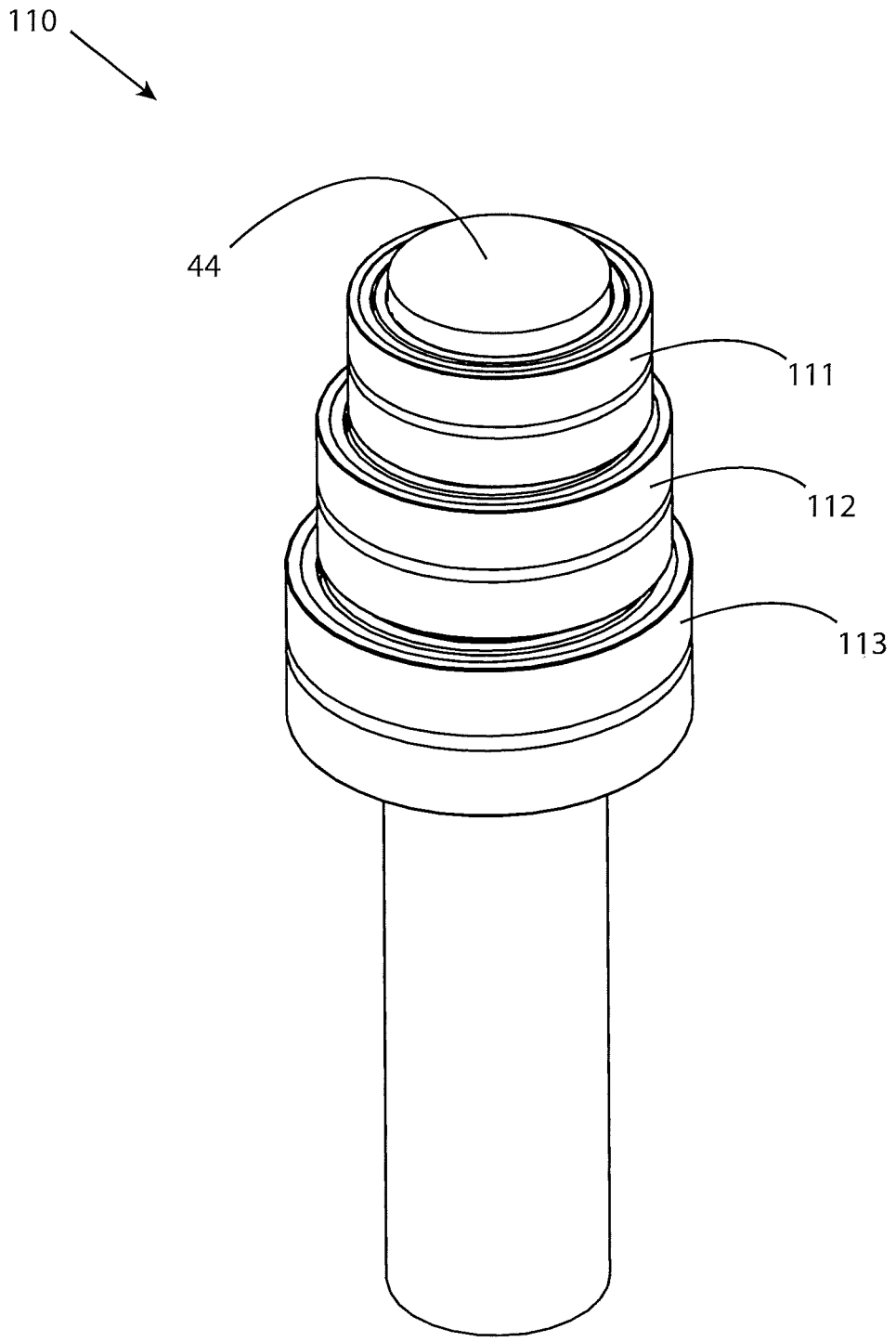
FIG. 17 is a shaft assembly of a fourth embodiment wherein the shaft includes multiple offset mandrel cylinders.
Figure 18:
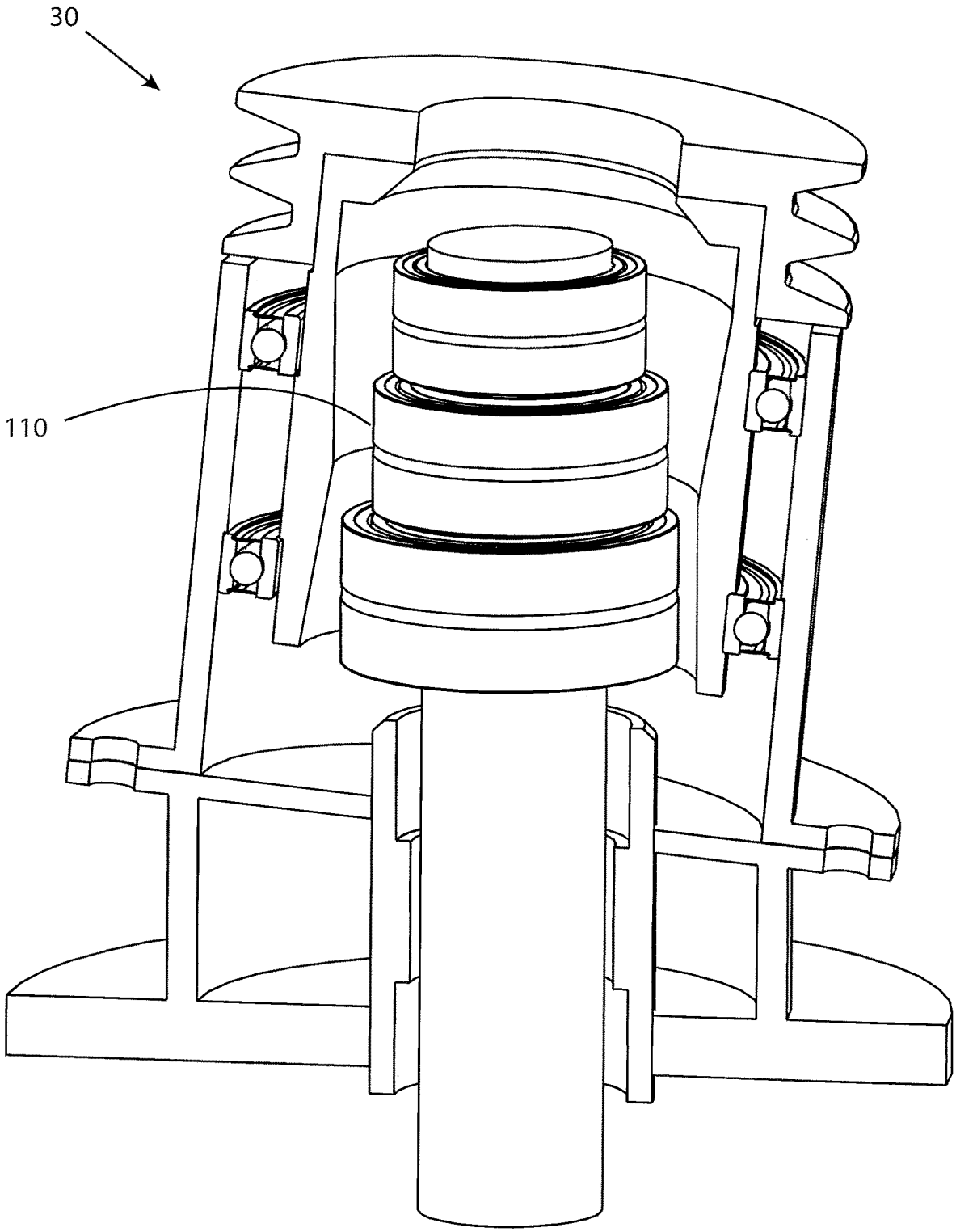
FIG. 18 is a mill assembly incorporating the shaft assembly of FIG. 17.

In a fifth embodiment of the shaft assembly 110, shown in FIG. 17, the mandrel comprises three cylinders, 111,112 and 113 fitted to a gyratory shaft 44. The three cylinders are axially offset with respect to each other and as a result the portions of each cylinder that is crushing the feed material will be angularly offset from each other. This greatly reduces vibration in the mill. A mill incorporating such a shaft assembly is shown in FIG. 18.

Further embodiments include mandrels with other numbers of offset cylinders as well as cylinders with differing heights and step offsets to those shown are anticipated by the invention.

The mill discussed so far and illustrated in the figures is able to process approximately 50 kg/hr of material such as calcium carbonate (marble containing 22% quartz @ mohs hardness of 4.5) reducing 1 mm feed material to a product with a $d_{50}$ of 9.5 microns using 40 kWh/t of specific energy in open circuit. In closed circuit this would represent 100% passing 9.5 microns using 33 kWh/t of specific energy. A 4 kW shell motor and 0.75 kW shaft motor is installed. The size of the components can be appreciated from the impact disc 70 which is approximately 95 mm in diameter and 10 mm thick.

For mills with a different throughput most components need merely to be scaled whilst keeping the stroke of the gyrator shaft and the clearance between the mandrel and the shell constant at approximately 1 mm and 2 mm respectively. The impact teeth should also be kept constant in size, but increase in number in line with the diameter of the impact disc.

A shaft motor speed of 500 rpm to 2,500 rpm is suitable for mills of varying sizes and results in an impact velocity of approximately 0.15 m/s at 1,500 rpm. For the mill discussed the shell is driven at 1,100 rpm resulting in a super-critical velocity for the material being processed ensuring it forms a compacted bed on the inside of the shell. For larger diameter mills the rpm can be scaled back whilst maintaining the same linear speed for the shell interior.

The mills discussed so far have had minimal adjustment possible, relying on changing or reconfiguring the shaft assembly. Adjustment of the crushing gap is desirable in order to produce different size product, and also to accommodate wear in the outer shell or the mandrel.

In a sixth embodiment of the milling system 500 shown in FIGS. 19 to 23, both the outer shell and the mandrel are frustoconical in shape and the outer shell is movable along its axis to vary the crushing gap between the shell and the mandrel.

Figure 19:
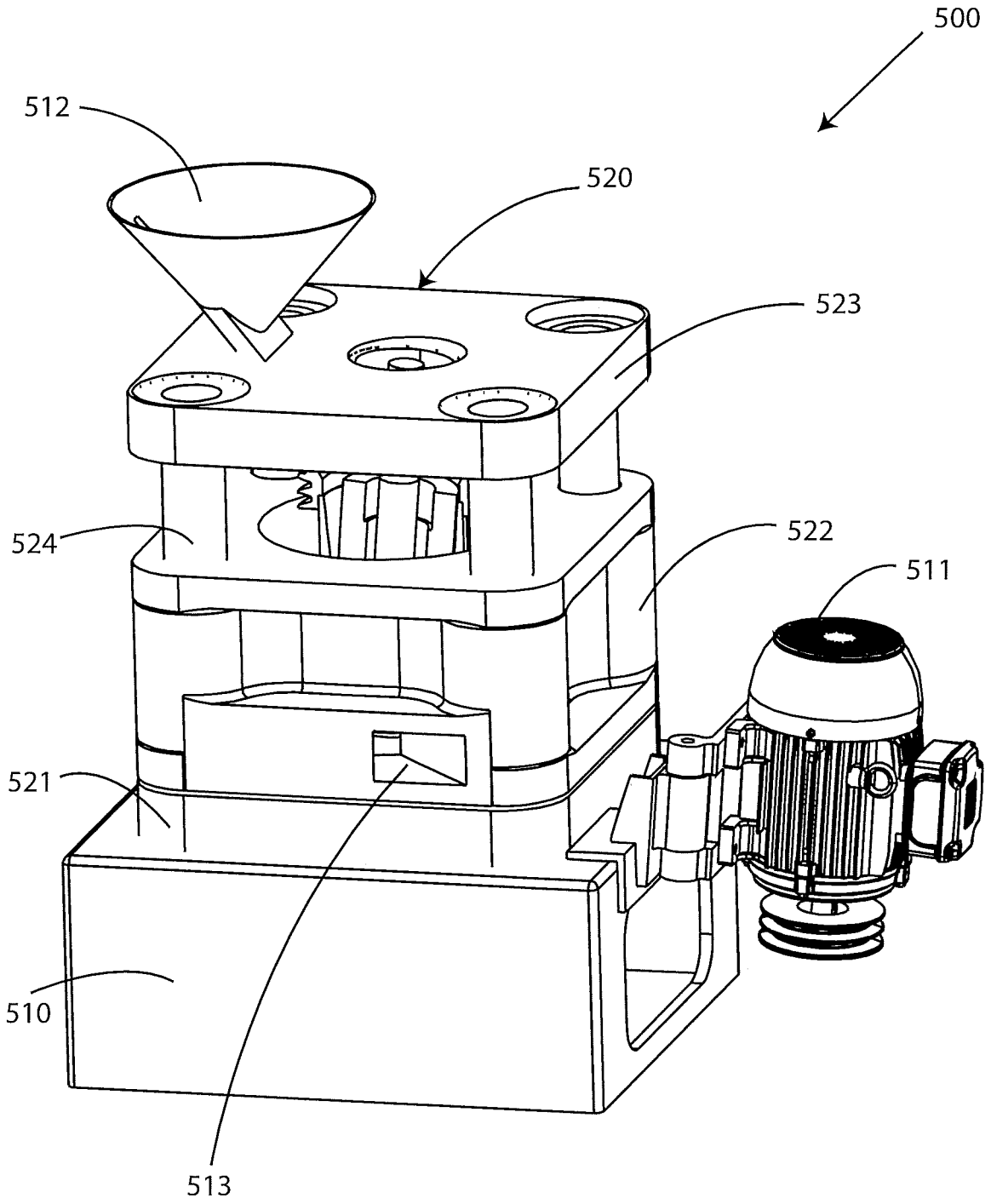
FIG. 19 is a perspective view of an adjustable milling system according to a sixth embodiment of the invention

FIG. 19 shows a milling system 500 which comprises an adjustable mill 520 mounted on a stand 510. The mill has a body 522 mounted on pillars 524 extending between a base 521 and top 523. The body is able to be moved vertically along the pillars to allow for adjustment of the crushing gap. Various mechanisms as are well known in the art may be used to adjust the position of the body. Similar to the previously described embodiments, the mill includes a motor 511 for driving a shaft assembly and a second motor (not visible) for driving an outer shell. Product enters the mill via funnel 512 and exits via chute 513.

Figure 20:
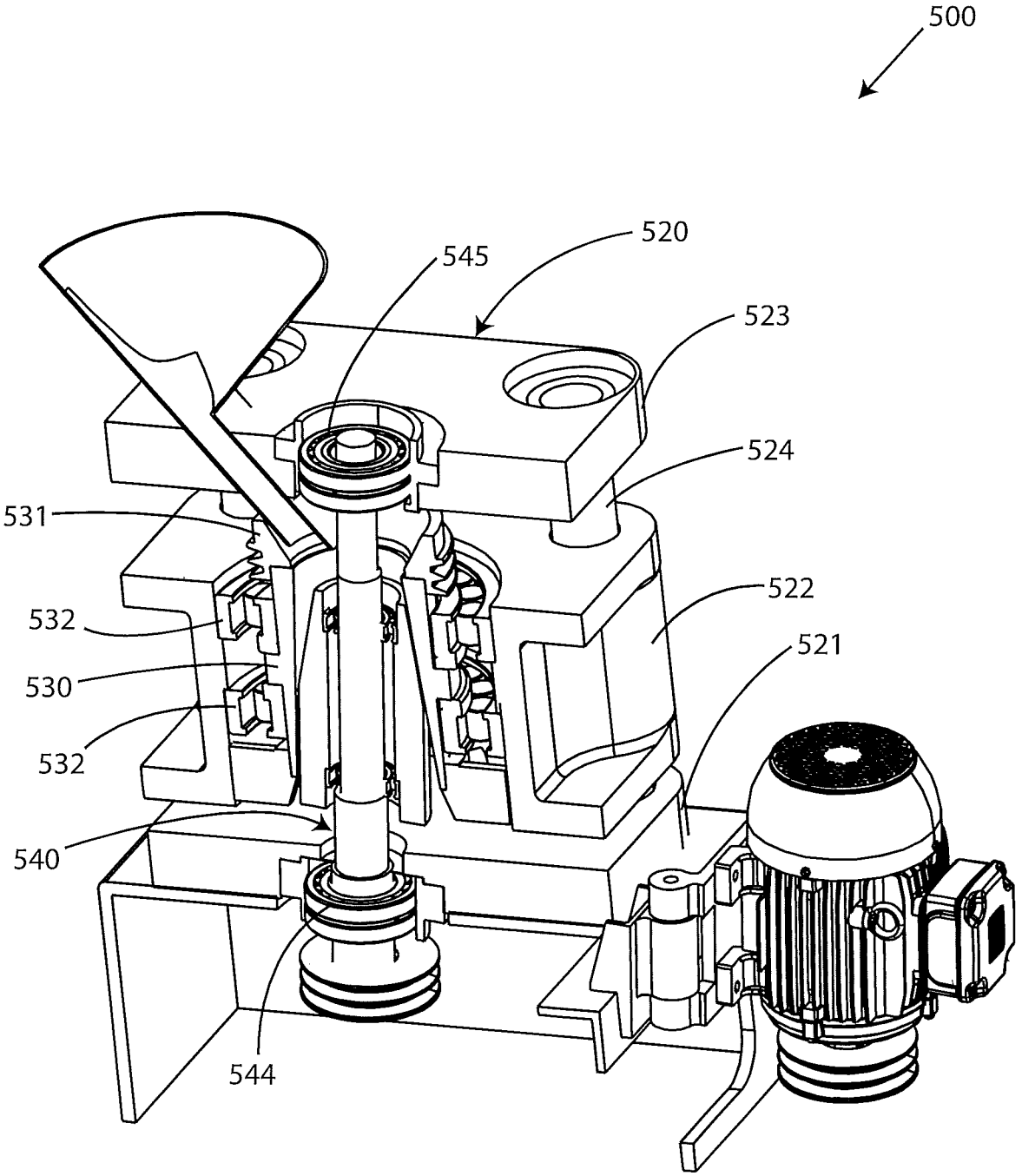
FIG. 20 is a partial cutaway view of the adjustable milling system of FIG. 19.

Further details of the milling system can be seen in the cut-away view of FIG. 20. The body 522 contains bearings 532 to hold the shell housing 530 which is driven via pulley 531. The shaft assembly 540 is retained in the base 521 by lower bearing 544 and in the top 523 by upper bearing 544. Similar to the other embodiments the shaft assembly and the shell housing are mounted at an angle to each other, but in this embodiment the shaft assembly, instead of the shell housing, is mounted at an angle to the vertical and the bulk of the components.

Figure 21:
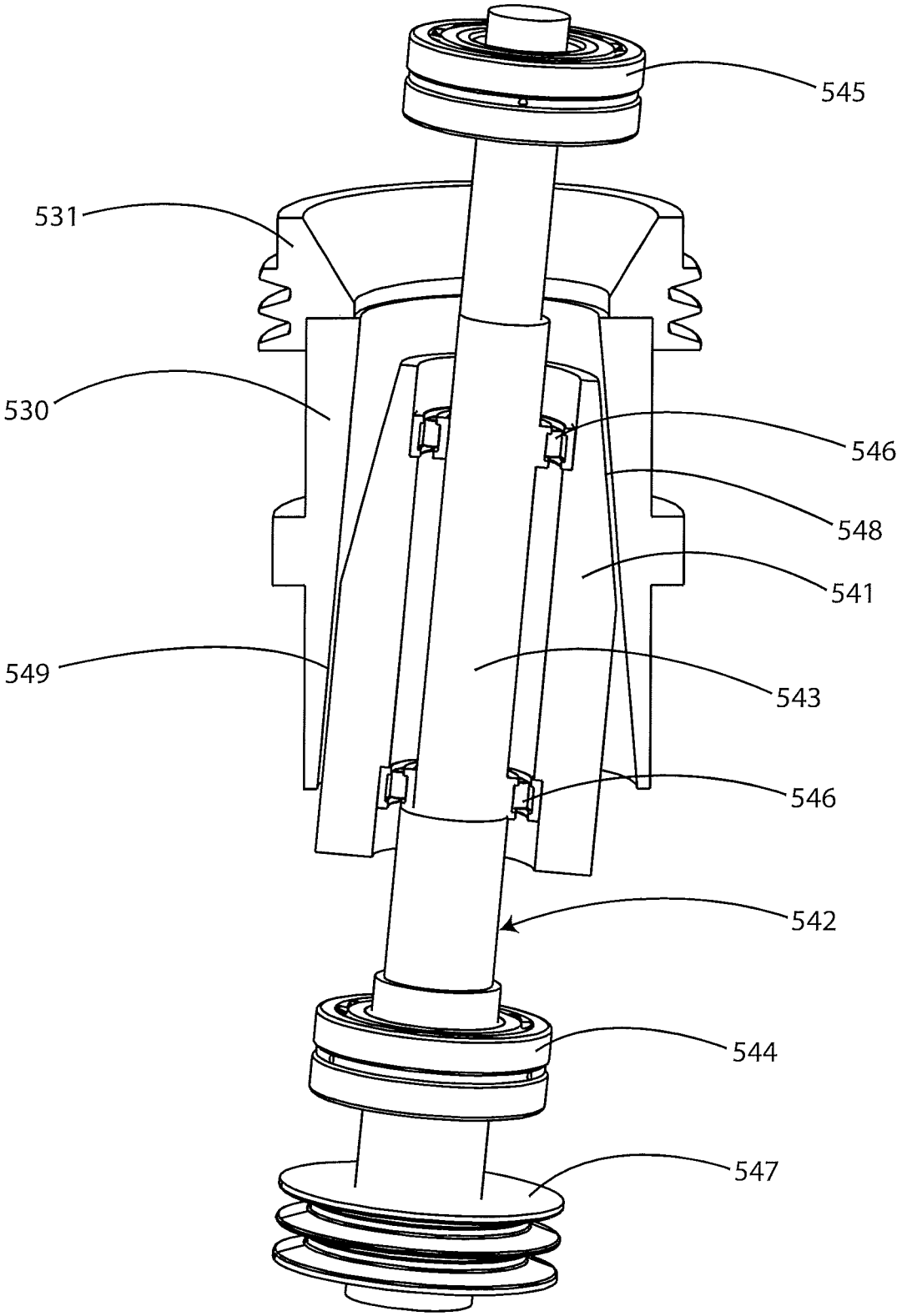
FIG. 21 is a detailed view of the shell housing and shaft assembly of the adjustable milling system of FIG. 19 with a first mandrel geometry and adjusted to a first grinding separation.

The shaft assembly and shell housing can be seen in isolation in FIG. 21. Again the shaft 542 has an offset segment 543 to impart a gyratory motion to the mandrel 541 which is mounted to the shaft via bearings 546. As before, the mandrel is free to rotate with respect to the shaft and will be slowly rotated by the product being ground as it is caught between the outer shell and the mandrel. The outer shell has a frustoconical inner surface complementing the frustoconical outer surface of the mandrel. A gap 548 between these two surfaces will expand and contract as the shaft rotates. The bottom half of the mandrel is cylindrical and forms a second crushing gap 549 with the lower half of the outer shell.

Figure 22:
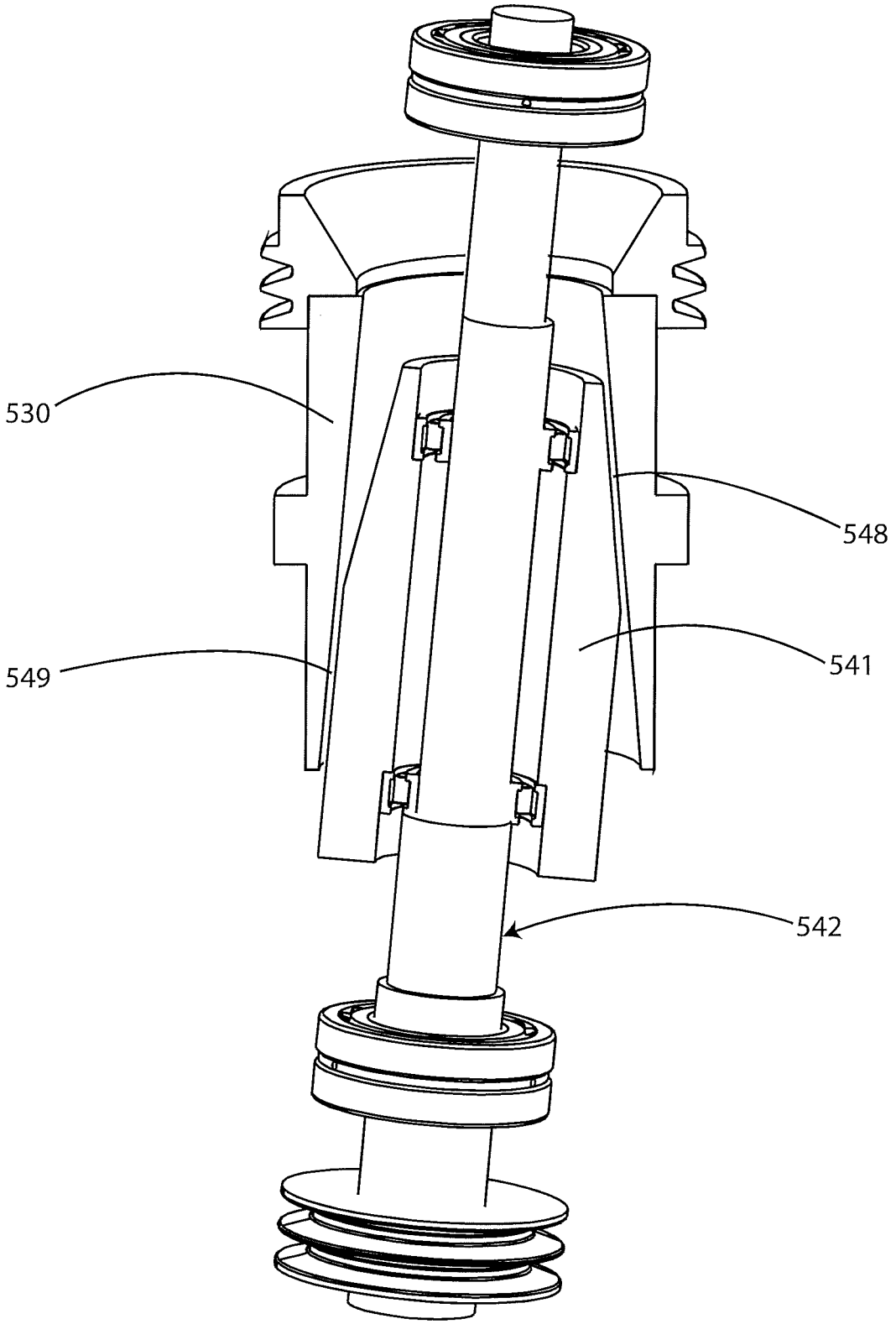
FIG. 22 shows the shell housing and shaft assembly of FIG. 21 adjusted to a second grinding position.
Figure 23:
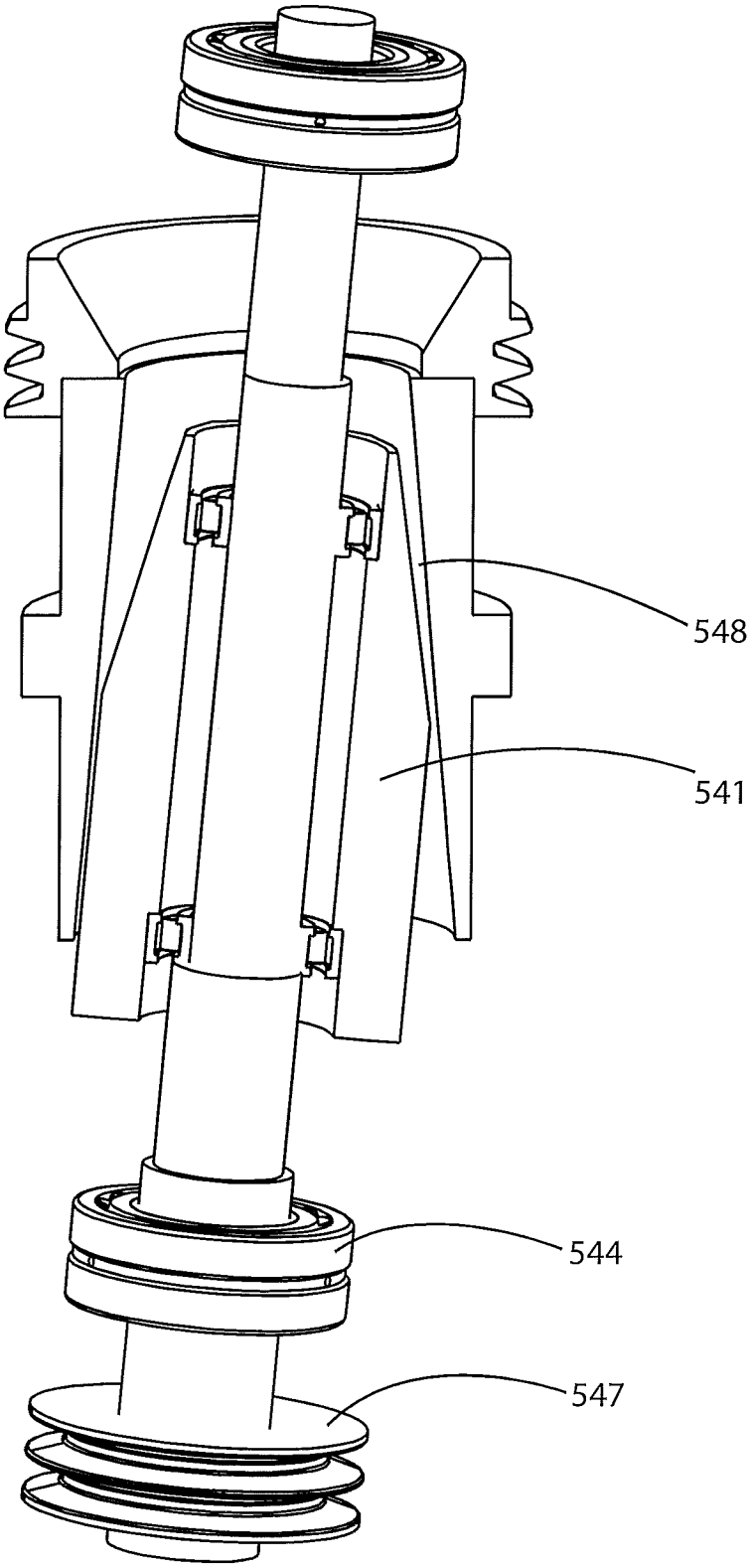
FIG. 23 is a detailed view of the shell housing and shaft assembly of the adjustable milling system of FIG. 19 with a second mandrel geometry.

The size of the gaps 548 and 549 can be varied by raising or lowering the outer shell 530 with respect to the mandrel 541. This is done to either select the size of product produced or to compensate for wear of either the outer shell or the mandrel. In FIG. 22 the shell housing has been raised vertically along its axis in comparison to FIG. 21 to increase both gaps 548 and 549. On the scale of FIGS. 21 and 22 this increase is approximately 0.5 mm which may be difficult to fully appreciate from the drawings.

In the embodiment shown in FIGS. 21 and 22 the geometry of the mandrel in conjunction with that of the outer shell and the offset angle between the two is chosen such that the gaps 548 and 549 are equivalent to each other and uniform along their length. For gap 549 to be uniform the angle between the shaft and the shell axis is equivalent to the angle of the inner surface of the shell. For gap 548 to be uniform the angle of the mandrel frusta is twice the angle of the inner surface of the shell. In further embodiments the geometry of these components is varied such that the gaps 548 and 549 may be the same or different to each other and both may vary along their length in either a continuous or stepwise matter. One such example is shown in FIG. 22 in which the upper gap 548 decreases linearly.

Figure 24:
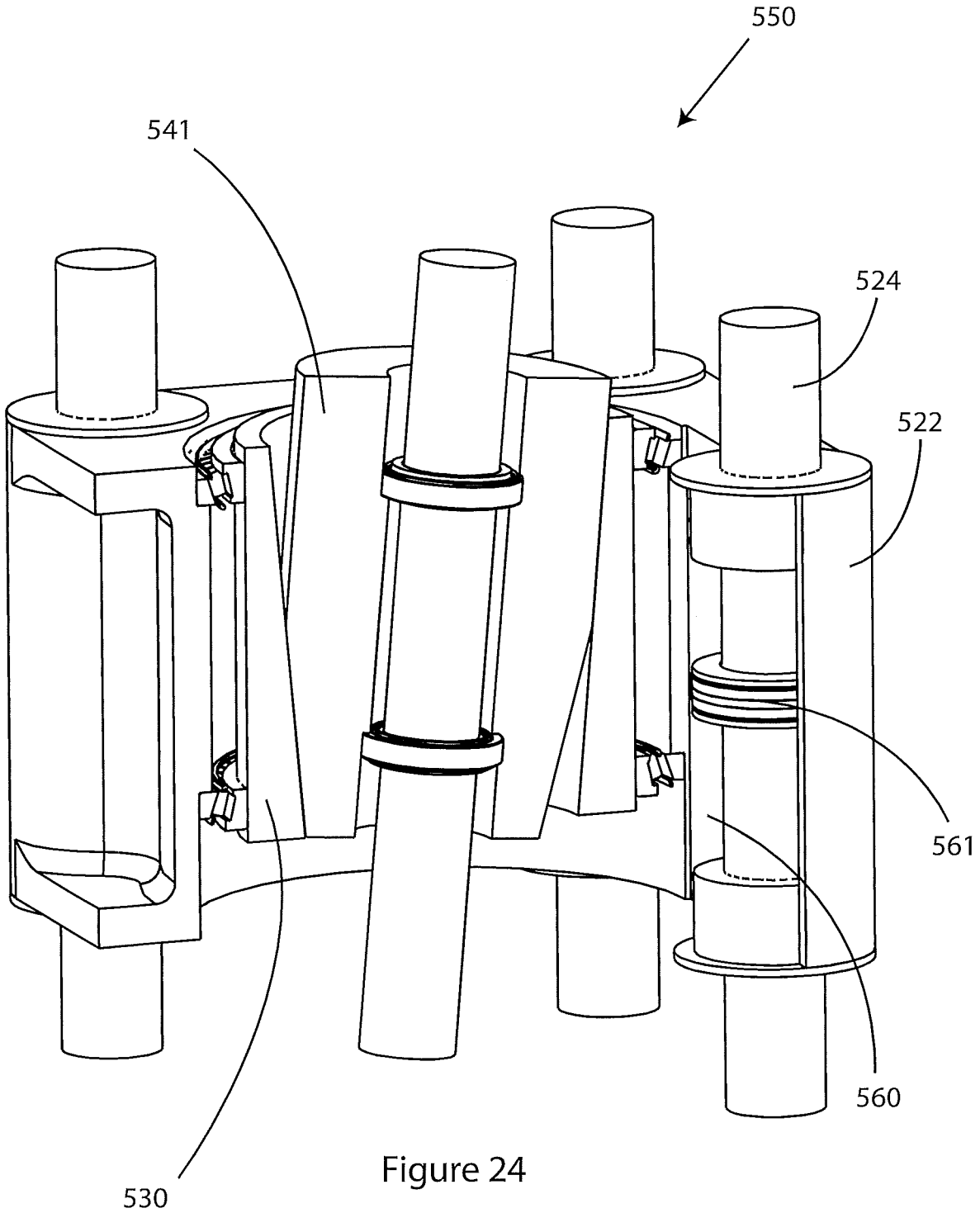
FIG. 24 is an adjustable milling system according to a seventh embodiment in which the crushing shell and mandrel are inverted in comparison to the system of FIGS. 19-22.

In a seventh embodiment of the mill shown as 550 in the cut-away view of FIG. 24 the shell housing and mandrel are flipped vertically in comparison to the milling system 500 of FIGS. 19-23. This has the benefit that if the raising mechanism for the body 522 should fail then the shell housing will fall away from the mandrel (instead of towards it) and thus avoid a potentially damaging jamming of the mill. The mill 550 also shows details of a raising mechanism. The body 522 can be seen to contain a hydraulic cylinder 560 and piston 561 to allow the body to be raised or lowered on the pillars 524.

The mill may also take further embodiments encompassing permutations of the separate features discussed. In a still further embodiment the mandrel is oscillatory instead of gyratory, with the mandrel moving back and forth on a fixed axis. In another further embodiment the mandrel and shell chamber are in the form of a sphere. In yet another embodiment the shell and the mandrel rotate on a common axis; this arrangement is simpler, but only suited to limited applications as it is less effective in drawing material through the mill.

The reader will now appreciate the present invention that provides a gyratory impact mill for the comminution of materials that offers superior energy usage characteristics over known mills. The mill may take various embodiments dependent on the type and size of input material, the desired size of product and the throughput required. The various embodiments all employ the same operating principle of using a low velocity gyrating mandrel for the comminution of material.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A mill for crushing particulate material comprising:

a rotatable shell;

a shell drive configured to rotate the shell at a super-critical velocity such that the particulate material forms a compressed solidified layer of material retained against an inner surface of the shell by centrifugal force;

a mandrel located within a chamber defined by the inner surface of the shell; and a gyrating drive, wherein the mandrel is mounted to the gyrating drive which imparts a gyrating motion to the mandrel;

wherein the mandrel is free to rotate independently of the gyrating drive and move in unison with the shell and the compressed solidified layer of material, such that the gyrating motion of the mandrel is perpendicular to the inner surface of the shell and the mandrel crushes and reduces the size of the particulate materials in the layer of material through impact.

2. The mill according to claim 1, wherein the shell rotates about a shell axis and the mandrel gyrates about a mandrel axis which is angularly displaced from the shell axis.

3. The mill according to claim 2, wherein the angular displacement of the mandrel axis from the shell axis is equivalent to the first angle of the first conical frustum.

4. The mill according to claim 2, wherein the shell is movable along the shell axis.

5. The mill according to claim 1, wherein the mandrel rotates about a gyratory axis and the shell rotates about a shell axis, wherein the rotation of the mandrel in unison with the shell results in a zero velocity or minimal velocity between the rotating mandrel and the rotating shell.

6. The mill according to claim 1, wherein the mandrel moves back and forth relative to the shell.

7. The mill according to claim 1, wherein, when the shell rotates at super-critical velocity, the layer of material is retained against the shell's inner surface by centrifugal force, regardless of the gyratory position of the mandrel.

8. The mill according to claim 1, wherein the shell and mandrel rotate in a same direction.

9. The mill according to claim 1, wherein the inner surface of the shell comprises a first conical frustum with a first lateral surface disposed at a first angle to a first axis and the mandrel comprises a second conical frustum with a second lateral surface disposed at a second angle to a second axis.

10. The mill according to claim 9, wherein the second angle of the second frustum is twice the first angle of the first frustum.

11. The mill according to claim 9, wherein the second angle of the second frustum is less than twice the first angle of the first frustum.

12. The mill according to claim 9, wherein the mandrel further comprises a cylinder.

13. The mill according to claim 1, wherein the mandrel comprises a series of rows of teeth, and wherein the teeth in adjacent rows are offset with respect to each other.

14. The mill according to claim 13, wherein each row of teeth comprises a disc in which the teeth are detachably retained.

15. The mill according to claim 1, wherein the mandrel includes a stepped outer surface.

* * * * *